US006215974B1

(12) United States Patent
Katoh et al.

(10) Patent No.: US 6,215,974 B1
(45) Date of Patent: Apr. 10, 2001

(54) IMAGE FORMING APPARATUS WITH A TONER MOUNTER HAVING A VIBRATION APPARATUS

(75) Inventors: Masahiko Katoh, Sagamihara; Nobuyuki Yanagawa, Chigasaki; Masanori Saito, Komae; Hideaki Kibune, Fujisawa; Akira Imai, Yokohama, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/307,609

(22) Filed: May 10, 1999

(30) Foreign Application Priority Data

May 8, 1998 (JP) ..... 10-125505
Dec. 9, 1998 (JP) ..... 10-349526

(51) Int. Cl.[7] ..... G03G 15/08
(52) U.S. Cl. ..... 399/258; 399/261
(58) Field of Search ..... 399/258, 260, 399/261, 106, 358, 111, 119, 120, 49, 58, 60, 61; 222/DIG. 1; 118/652

(56) References Cited

U.S. PATENT DOCUMENTS 4,406,535 9/1983 Sakamoto et al. ..... 399/274
4,942,432 * 7/1990 Mort et al. ..... 399/106
5,414,497 * 5/1995 Tsuchiya et al. ..... 399/261 X
5,517,285 * 5/1996 Nomura et al. ..... 399/261 X
5,563,697 * 10/1996 Saito ..... 399/358
5,722,018 * 2/1998 Hart et al. ..... 399/258
5,887,223 * 3/1999 Sakai et al. ..... 399/60

FOREIGN PATENT DOCUMENTS 61-170760 * 8/1986 (JP) .
1-202779 * 8/1989 (JP) .
1-259381 * 10/1989 (JP) .
2-293770 * 12/1990 (JP) .
5-241487 * 9/1993 (JP) .

OTHER PUBLICATIONS

Patent Abstracts of Japan, JP 10–031342, Feb. 3, 1998.

* cited by examiner

*Primary Examiner*—Arthur T. Grimley
*Assistant Examiner*—Hoan Tran
(74) *Attorney, Agent, or Firm*—Oblon, Spivak, McClelland, Maier & Neustadt, P.C.

(57) ABSTRACT

A developing apparatus for supplying toner includes a toner hopper configured to hold unused toner, a developing tub, and a toner hopper mounting part provided between the developing tub and the toner hopper. The toner hopper is adapted to be mounted to and removed from the toner hopper mounting part. The toner hopper mounting part includes a vibration apparatus for vibrating the toner hopper mounting part to loosen the unused toner stored in the toner hopper.

34 Claims, 20 Drawing Sheets

IMAGE FORMING APPARATUS WITH A TONER MOUNTER HAVING A VIBRATION APPARATUS

BACKGROUND OF THE INVENTION

1. Field of the Invention

The present invention relates to a developing apparatus for converting an electrostatic latent image to a visible image and to an image forming apparatus using the inventive developing apparatus. The present invention also relates to a method of supplying toner in an image forming apparatus.

2. Discussion of the Background

In the image forming apparatus to which the electrophotographic copying method is applicable such as copying machine, facsimile device, or printer, a developing process of supplying toner employed as developer (i.e., a developing agent) (hereinafter, "toner") to an electrostatic latent image formed on the image carrier, such as a photosensitive body is performed. The electrostatic latent image is converted to a visible image.

The developing apparatus employed in the developing process is constructed with a developing sleeve opposing the image carrier in the developing tub and supplying the toner carried on the surface thereof to the image carrier. A toner replenishing part is mounted on the developing tub and contains unused toner in the interior of the developing tub.

In the developing apparatus, visible image treatment for the electrostatic latent image (i.e., the developing process) is performed by electrostatically absorbing toner carried on the developing sleeve by the action of the electrostatic attraction force of the electrostatic latent image formed on the image carrier. When the amount of the toner contained in the developing tub becomes insufficient, the toner is replenished from the toner replenishing part.

The toner replenishing part is provided with, for instance, a container (such as a bottle, a hopper, etc.) containing unused toner in the interior thereof and disposed such that the opening thereof is directed downward. By driving the toner replenishing member installed on the opening part, the necessary (or required) amount of the toner is replenished to the developing tub.

Here, the toner contained in the toner replenishing part has a comparatively strong attraction force between the toner particles, and the toner is apt to be solidified in the container. When the toner is solidified therein, only a part of the solidified toner is peeled off in the container, and the other part thereof remains solidified in the container, and thus, all toner cannot be replenished on some occasions.

Furthermore, even though the toner slips down in the container, the solidified toner may set into the developing tub and/or cause the exhaust opening to become clogged with the solidified toner.

In order to solve such troublesome matters, a vibration is applied to the toner discharged from the container, and the toner is broken into pieces and/or pulverized. As a result, the toner is dispersed uniformly and supplied into the developing tub. Such structure is disclosed, for instance, in the published specification of the Japanese Laid-Open Patent Publication No. 6-222672/1994. Or otherwise, the bottle is rotated and pulsed so that the toner contained in the developing tub is demolished by an agitating member disposed therein.

Such structure is disclosed, for instance, in the published specification of the Japanese Laid-open Utility Model Publication No. 6-69961/1994.

However, according to the former structure, the solidification of the toner contained in the bottle or the hopper cannot be eliminated, while, according to the latter structure, there arises a new problem that it is necessary to further prepare a special structure for equipping the bottle with the agitating member and/or controlling the rotation of the bottle.

SUMMARY OF THE INVENTION

Accordingly, it is an object of the present invention to solve the problems discussed above.

It is another object of the present invention to provide a developing apparatus and an image forming apparatus using the developing apparatus that avoid the problems discussed above.

It is still another object of the present invention to provide a developing apparatus and an image forming apparatus using the developing apparatus capable of preventing the problem that the contained toner remains in the container, in particular, in consideration of the structure of replenishing the toner.

It is still another object of the present invention to provide a developing apparatus and an image forming apparatus using the developing apparatus, having a simple structure and a low maintenance cost.

These and other objects are achieved according to the invention by providing a developing apparatus that supplies toner to a latent image on a latent image carrier. The developing apparatus includes a toner hopper configured to hold unused toner, a developing tub, and a toner hopper mounting part provided between the developing tub and the toner hopper. The toner hopper is adapted to be mounted to and removed from the toner hopper mounting part. The toner hopper mounting part includes a vibration apparatus.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
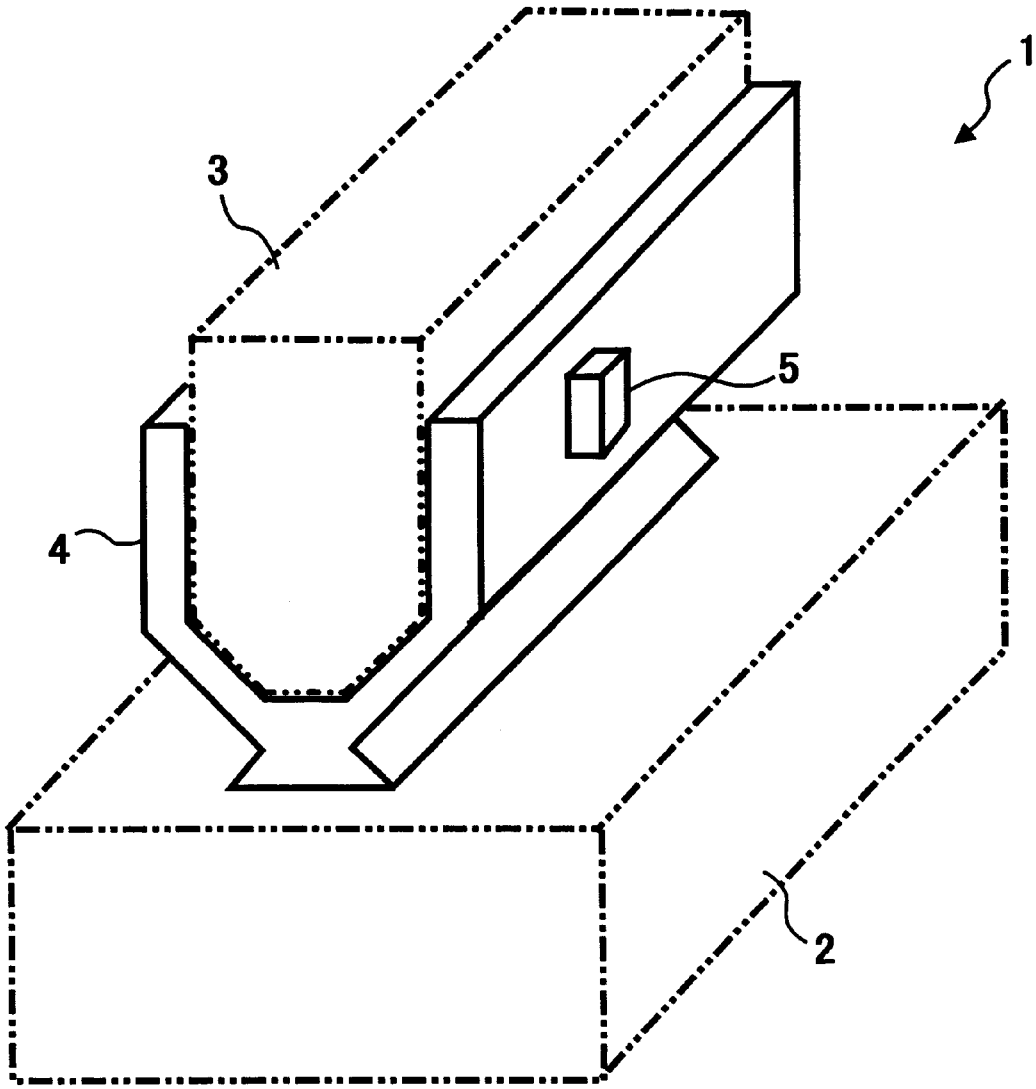
FIG. 1 is a schematic perspective view illustrating the developing apparatus of the present invention.
Figure 11:
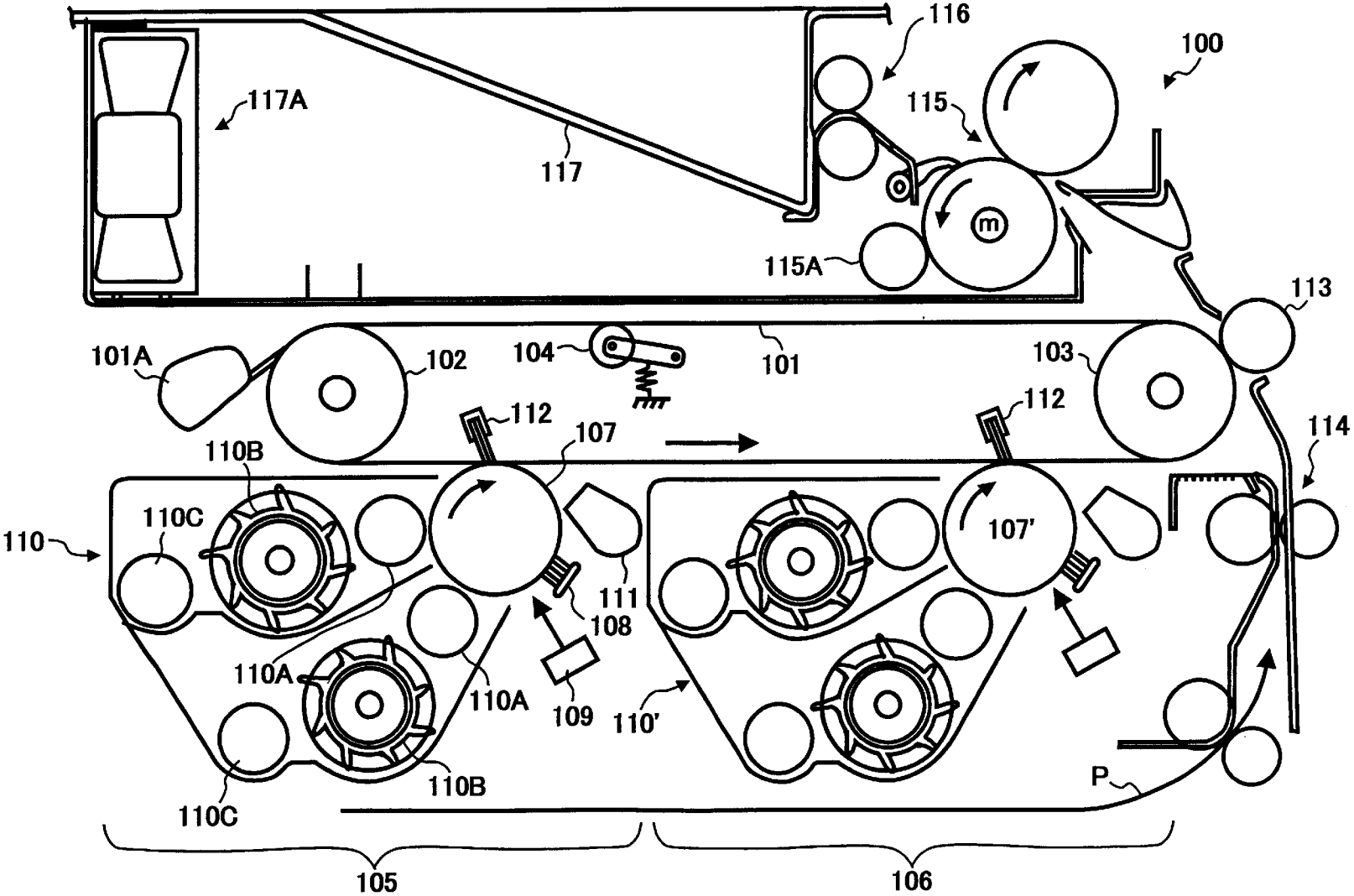
FIG. 11 is a cross-sectional view of the image forming apparatus of the present invention.

Referring now to the drawings, wherein like reference numerals designate identical or corresponding parts throughout the several views, and more particularly to FIG. 1 thereof, there is illustrated a developing apparatus 1 for supplying toner to a latent image carried on a latent image carrier and for converting the latent image to a visible image with the toner. The developing apparatus 1 includes a toner hopper 3 containing unused toner and a toner hopper mounting part 4 provided with a vibration apparatus 5. FIG. 11 shows an image forming apparatus using the above-mentioned developing apparatus 1.

In order to attain the aforementioned objects of the present invention, in the developing apparatus there is provided a toner hopper containing therein unused toner and a toner hopper mounting part communicating with a developing tub in the developing apparatus with the toner hopper and capable of setting up the toner hopper therein. The toner hopper mounting part includes a vibration apparatus mounted thereon.

The vibration apparatus includes a motor and an eccentric part formed on the rotative shaft of the motor. The motor is fixed on the wall (or surface) portion of the toner hopper mounting part, and the size of the above-mentioned eccentric part is smaller than the outer size of the motor. The vibration apparatus is constructed with a piezoelectric element mounted on the wall portion of the toner hopper mounting part. The toner hopper mounting part has plurality of vibration apparatuses.

In such developing apparatus, given that the frequency of the vibration, fm, and the inherent frequency of the toner hopper mounting part, fs, the respective factors are set so as to satisfy the following inequalities $$(fm/\sqrt{2})<fs<(\sqrt{2}\cdot fm).$$

On the other hand, given the frequency of the applied vibration, fm, and the inherent frequency of the toner hopper, fh, the respective factors are set so as to satisfy the following inequalities $$(fm/\sqrt{2})<fh<(\sqrt{2}\cdot fm).$$

In this latter case, the vibration applying frequency fm can be changed.

In the image forming apparatus using the developing apparatus as mentioned heretofore, when the density of a standard density pattern image reaches a value equal to or smaller than a predetermined density, the vibration apparatus provided in the toner hopper mounting part, on which the toner hopper is detachably supported, is driven such that the toner hopper resonates, and toner is caused to flow in the toner hopper and supplies the latent image carrier.

A plurality of developing apparatuses may be provided corresponding to the electrostatic latent images for each of the respective colors formed on the latent image carrier. The developing apparatus is disposed in an opening portion capable of opening and closing by use of a cover provided on the upper part of the main body of the image forming apparatus.

A toner supplying unit for supplying toner may be attached to, and detached from, the developing apparatus at the opening. The vibration apparatus can initiate lengthwise (i.e., vertical) vibration. The vibration apparatus can be controlled to initiate the vibration at times other than the image forming time. The developing apparatus is constructed such that the vibration of the vibration apparatus does not propagate between the respective colors. The developing apparatus can change the vibration applying intensity of the vibration apparatus for each of the respective colors. The hoppers are square-shaped in the respective developing apparatuses. One end of the hopper is made in a conical shape. An opening portion is formed at the tip end portion of the hopper. A toner supply controlling device for controlling the supply of toner is provided in the opening portion. The toner supply controlling device is formed of a mesh material having mesh size of 50 to 500 $\mu$m. The hopper is constructed such that the toner contained therein can be seen from outside the hopper. The hopper may be provided with a cap having an opening portion capable of being opened and closed, and the hopper is replenished with toner by removing the cap.

FIG. 1 is a schematic diagram for explaining the principle and the structure of a developing apparatus according to the present invention.

In FIG. 1, the developing apparatus 1 is provided with a developing tub 2 containing therein a developing sleeve and an agitating wing and a toner hopper 3. The developing sleeve is constructed with a rotative sleeve capable of forming a magnetic brush, and the agitating wing agitates the toner contained in the developing tub. Thus, the toner is frictionally charged.

The toner hopper 3 is mounted on a toner hopper mounting part 4 provided on a suitable portion of the developing tub 2 so as to be attached to, or detached from, the toner hopper mounting part 4. The hopper 3 can be exchanged. The toner hopper mounting part 4 is provided on the communicating portion between the developing tub 2 and the toner hopper 3. The toner hopper 3 can be mounted so as to be attached to, or detached from, the toner hopper mounting part 4.

A vibration apparatus 5 is mounted on an outer surface of the toner hopper mounting part 4. The vibration apparatus 5 controls the vibration starting time and the vibration duration time in accordance with a signal received from the density sensor. When the outer wall of the toner hopper mounting part 4 is vibrated by the vibration apparatus 5, the vibration is transmitted to the toner hopper 3. In the present invention, when the density sensor detects that the density of a standard density pattern formed on the photosensitive body reaches a value equal to or smaller than a predetermined density value, the vibration apparatus operates until the density thereof exceeds the predetermined value.

In the structure of the present embodiment, the toner hopper 3 containing the unused toner is inserted into the toner hopper mounting part 4. When the density sensor detects that the density of a standard density pattern formed on the photosensitive body is low, the vibration apparatus 5 starts its operation, and in this manner, the outer wall of the toner hopper mounting part 4 is vibrated.

When the outer wall thereof is vibrated, the vibration of the outer wall is transmitted to the toner hopper 3. When the vibration is transmitted to the toner hopper 3, the toner hopper 3 is also vibrated. The vibration is applied to the toner contained in the toner hopper 3 and the toner is broken into small pieces and/or pulverized. The distance between the toner particles increases to the extent that the attraction (or attracting) force between the toner particles does not cause the toner particles to clump together. Thus, the toner can flow toward the discharging opening of the toner hopper 3.

Figure 2:
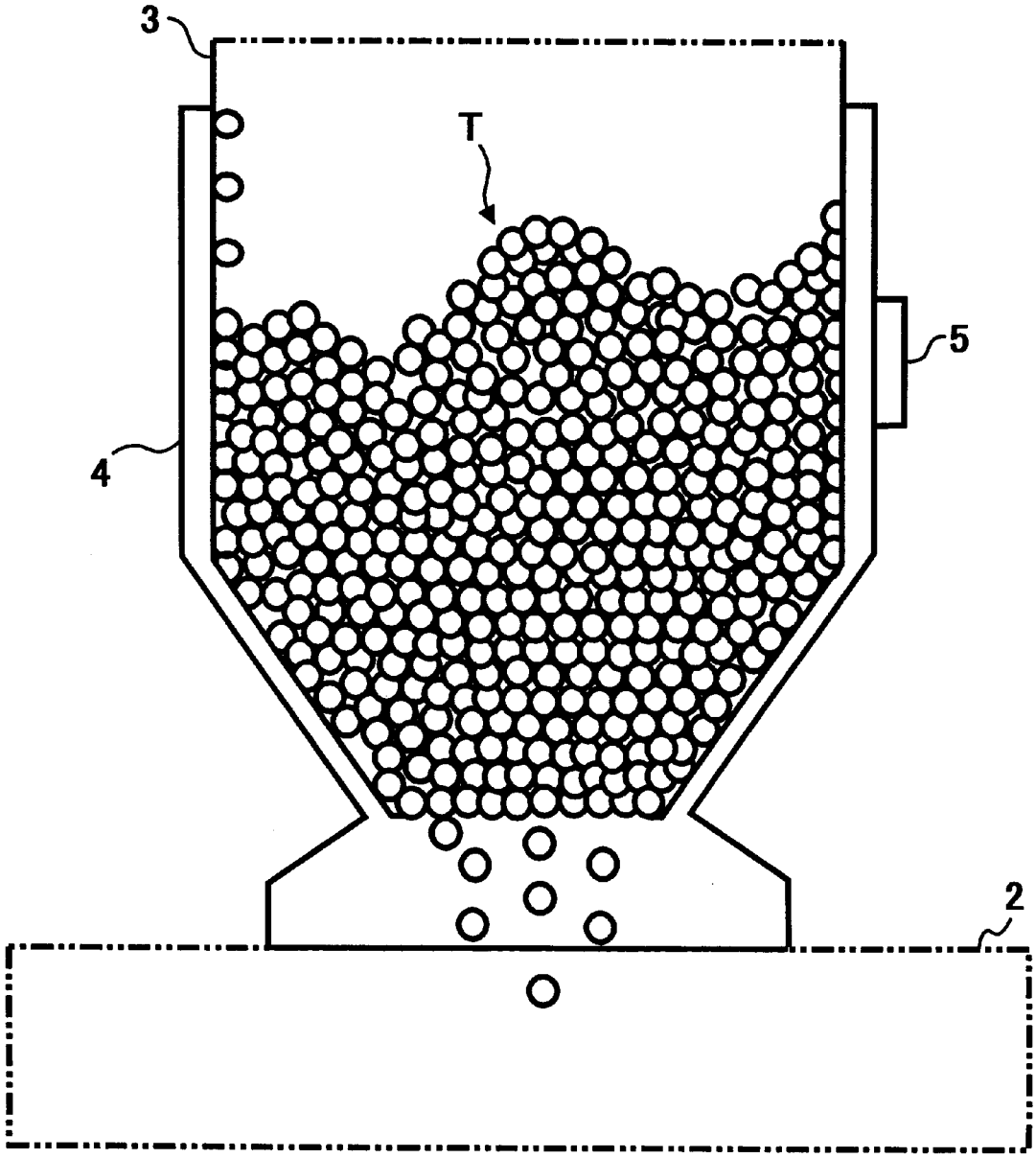
FIG. 2 is a cross-sectional view of the developing apparatus of FIG. 1 showing how toner is discharged when the vibration apparatus 5 of the developing apparatus is not operating.

As shown in FIG. 2, when the vibration from the vibration apparatus 5 is not transmitted to the toner hopper mounting part 4, the toner T contained in the interior of the toner hopper solidifies due to the influence of the attraction force between the toner particles. Thus, the toner is not apt to slide down toward the toner discharging opening.

Figure 3:
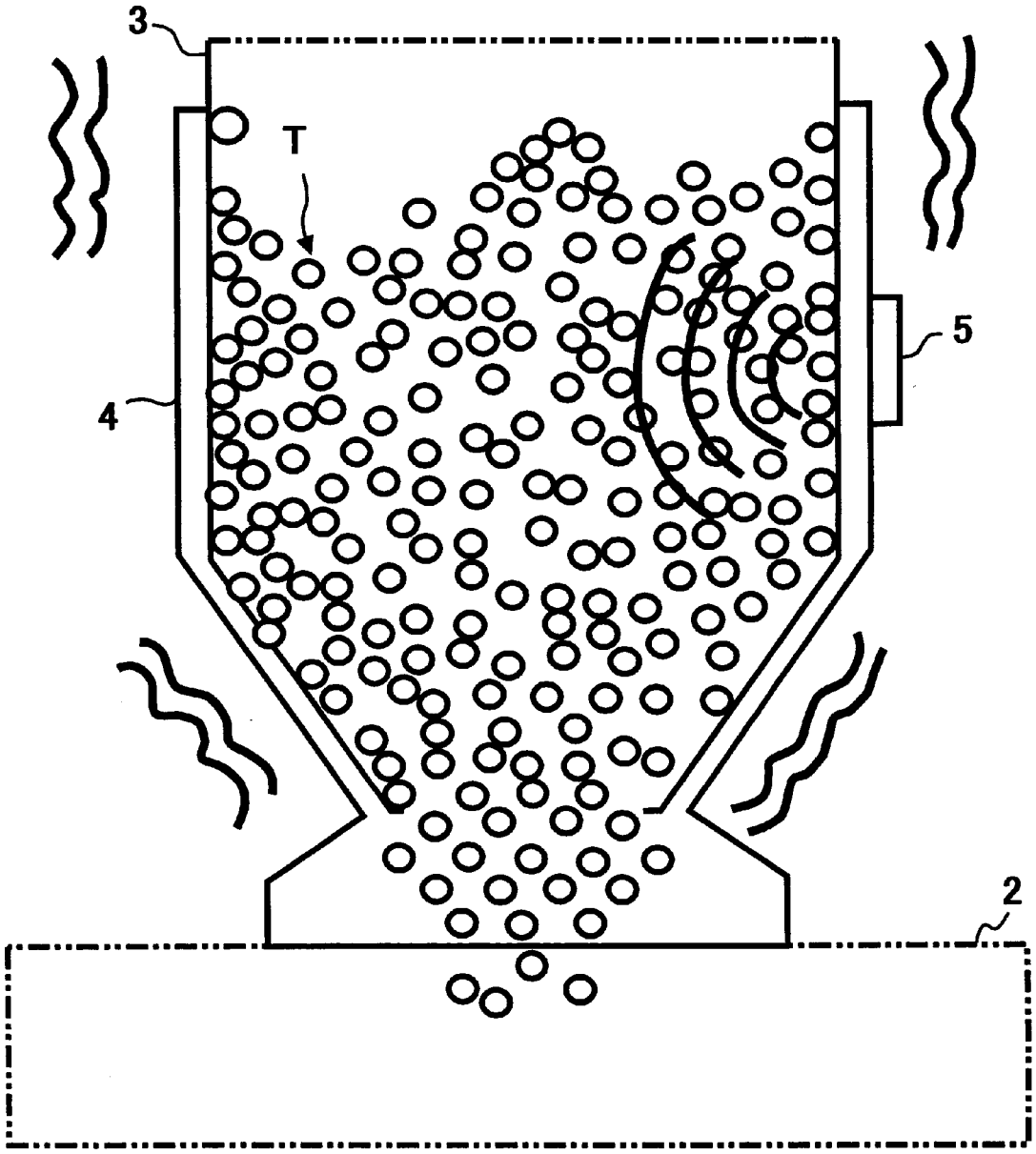
FIG. 3 is a cross-sectional view of the developing apparatus of FIG. 1 when the vibration apparatus is operating.

However, as shown in FIG. 3, when the vibration apparatus 5 operates, the toner particles T themselves are mutually vibrated due to the vibration of the toner hopper through the toner hopper mounting part 4 (for convenience, represented by vibration waves), and the distance between the toner particles is widened, and thereby the mutual positions of the toner particles are changed. Consequently, the toner particles become in a fluid-like state and are able to slip down to the toner discharging portion.

Furthermore, since the toner particles are caused to settle downward by the action of the vibration, the toner can flow out from the toner discharging opening without clogging the toner discharging opening.

Since the toner particles contained in the toner hopper 3 are vibrated by applying the vibration to the entire toner hopper 3 instead of the toner discharging opening, the fluidity of the toner can be obtained over the entire area of the interior of the toner hopper 3. Consequently, the toner solidified on positions other than the toner discharging opening in the toner hopper 3 can be prevented from remaining solidified within the hopper.

In order to vibrate the entire area of the toner hopper 3, the vibration apparatus, such as a motor, may be placed in the toner hopper 3. However, the motor may clog the toner and/or fail to vibrate.

On the other hand, if a vibration apparatus is mounted on the outer wall surface of the toner hopper mounting part 4, the motor cannot clog the toner and is less likely to malfunction. Furthermore, since the vibration apparatus 5 is provided on the toner hopper mounting part 4 instead of the toner hopper 3, the toner hopper can be easily exchanged with other toner hoppers. Furthermore, it is not necessary to perform the troublesome task of installing the vibration apparatus in the new toner hopper when the toner hopper 3 is exchanged.

Furthermore, when the vibration apparatus 5 is driven based on the density of a standard density pattern formed on the photosensitive body. When the density is lower than (or equal to or lower than) the density of the standard density pattern, the attraction of the toner particles to one another can be greatly reduced. Also, situations in which the toner is blocked or clumps of toner is replenished can be avoided. Consequently, it is possible to supply the new toner uniformly to the photosensitive body. Thus, the unevenness of the density on the photosensitive body can be eliminated. Alternatively or in addition to being formed on the photosensitive body, the same standard density pattern or a different standard density pattern may be formed on an intermediate transfer body (e.g., drum, belt, etc.), if the image forming apparatus is provided with an intermediate transfer body.

Figure 4A:
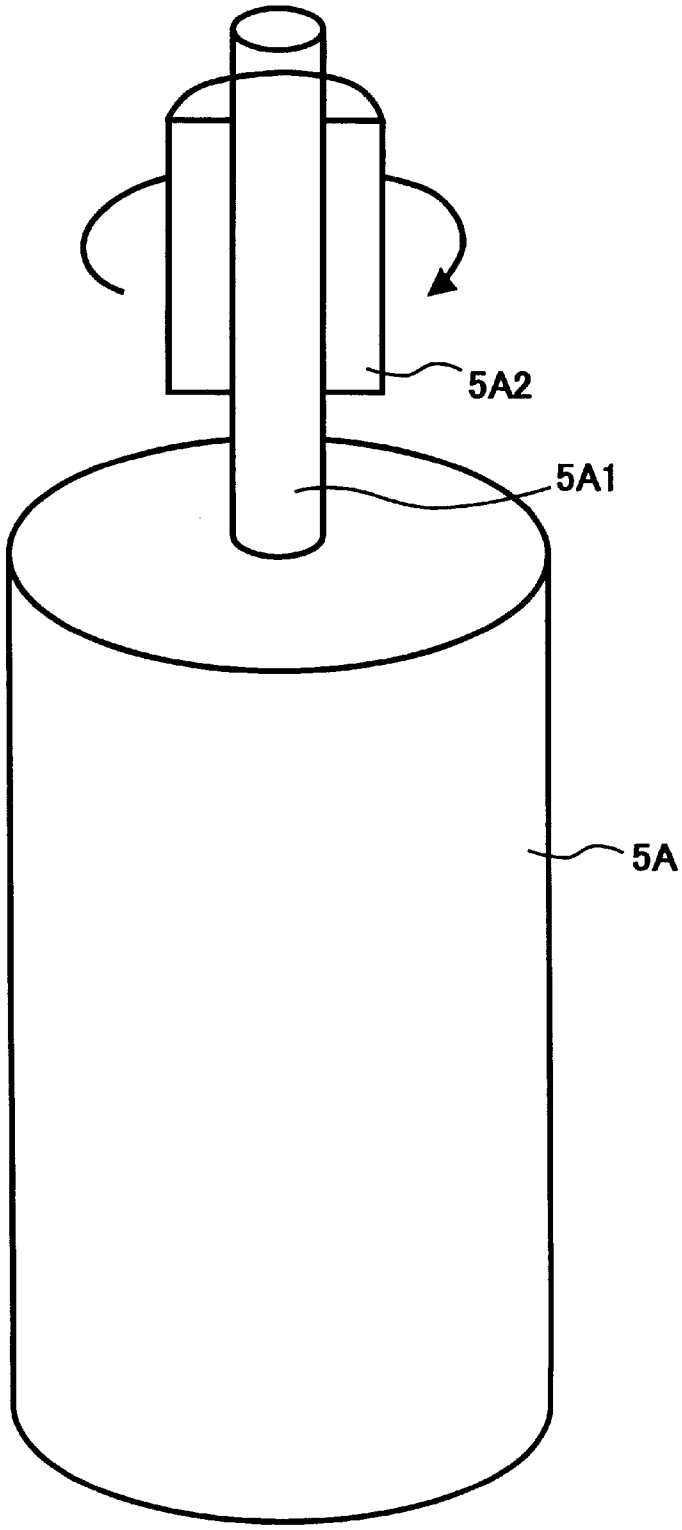
FIG. 4A is a schematic view illustrating a motor used as the vibration apparatus 5 of the developing apparatus of FIG. 1.
Figure 4B:
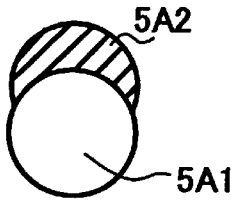
FIGS. 4B through 4G are plan views showing examples of eccentric members attached to the shaft of the motor in FIG. 4A.
Figure 4C:
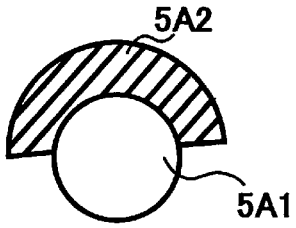
Figure 4D:
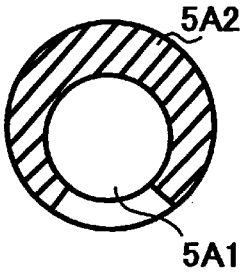
Figure 4E:
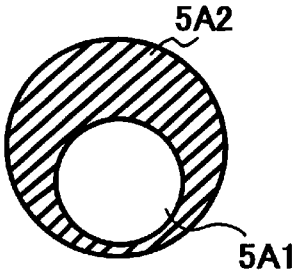
Figure 4F:
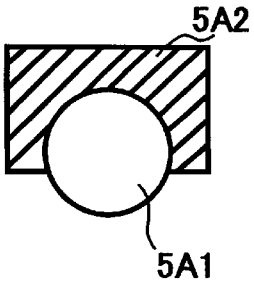
Figure 4G:
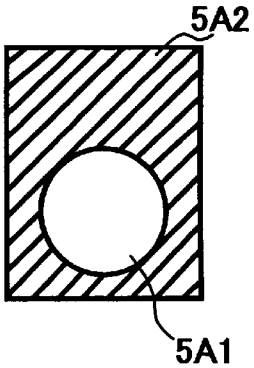

FIG. 4A shows a motor 5A employed as the vibration apparatus 5. FIG. 4A is a perspective view showing the overall structure of the vibration apparatus. FIGS. 4B through 4G are plan views showing some examples of eccentric members attached to the shaft of the motor 5A. In FIG. 4A, the motor 5A is a small-sized motor such as the type used to vibrate a portable telephone set. A weight 5A2 is fixed on the area corresponding to one side of the circular circumferential direction of the rotation shaft 5A1.

The size of the outer diameter of the weight 5A2 is smaller than that of the motor 5A. When the motor rotates, the weight 5A2 is not brought into contact with the outer surface (wall) of the toner hopper mounting part 4. Several possible shapes of the weights 5A2 attached to the motor shaft are as shown in FIGS. 4B through 4G. Those weights can be fixed on the shaft by a screw, adhesive agent, by tight (fixed) insertion, etc. The eccentric member (i.e., weight 5A2) vibrates, and its vibration is transmitted to the toner hopper 3 through the toner hopper mounting part 4.

In such structure of the present embodiment as mentioned above, the motor 5A is fixed on the outer surface of the toner hopper mounting part 4. As in the case of the embodiment shown in FIG. 1, the motor 5A is rotated by the signal from the density sensor. When the rotation shaft 5A1 is rotated by the motor 5A, the motor 5A itself is vibrated by the action of the centrifugal force due to the shift of the center of gravity of the weight 5A2 around the center of the rotation shaft 5A1.

Figure 5:
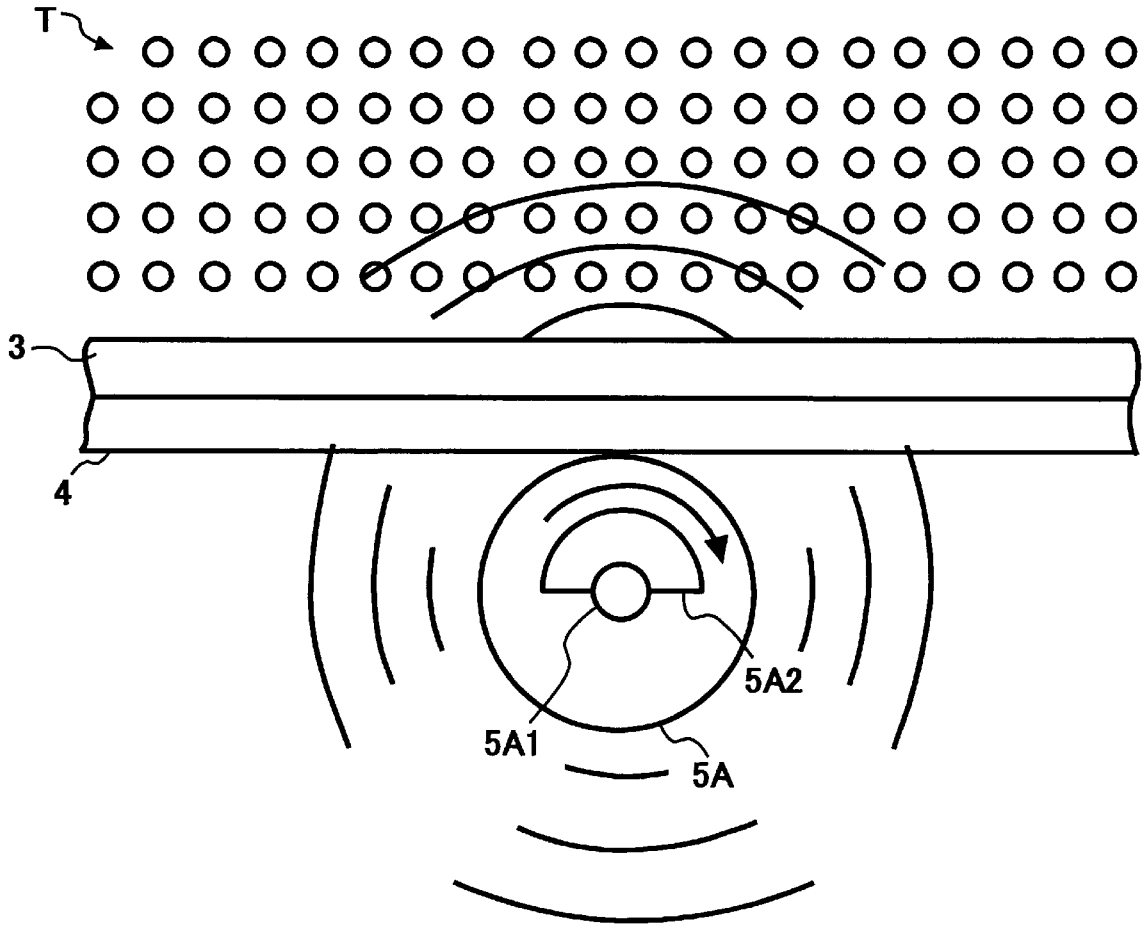
FIG. 5 is an explanatory diagram showing the state of the vibrating toner when the motor shown in FIG. 4A is used.

As shown in FIG. 5, since the weight 5A2 does not directly hit the outer surface of the toner hopper mounting part 4 and the vibration of the motor 5 occurs due to the centrifugal force, the vibration applying frequency can be made comparatively low. Thus, it is possible to prevent the toner from being consolidated due to the small impact force exerted on the toner. Consequently, the toner can be kept fluid.

Figure 6A:
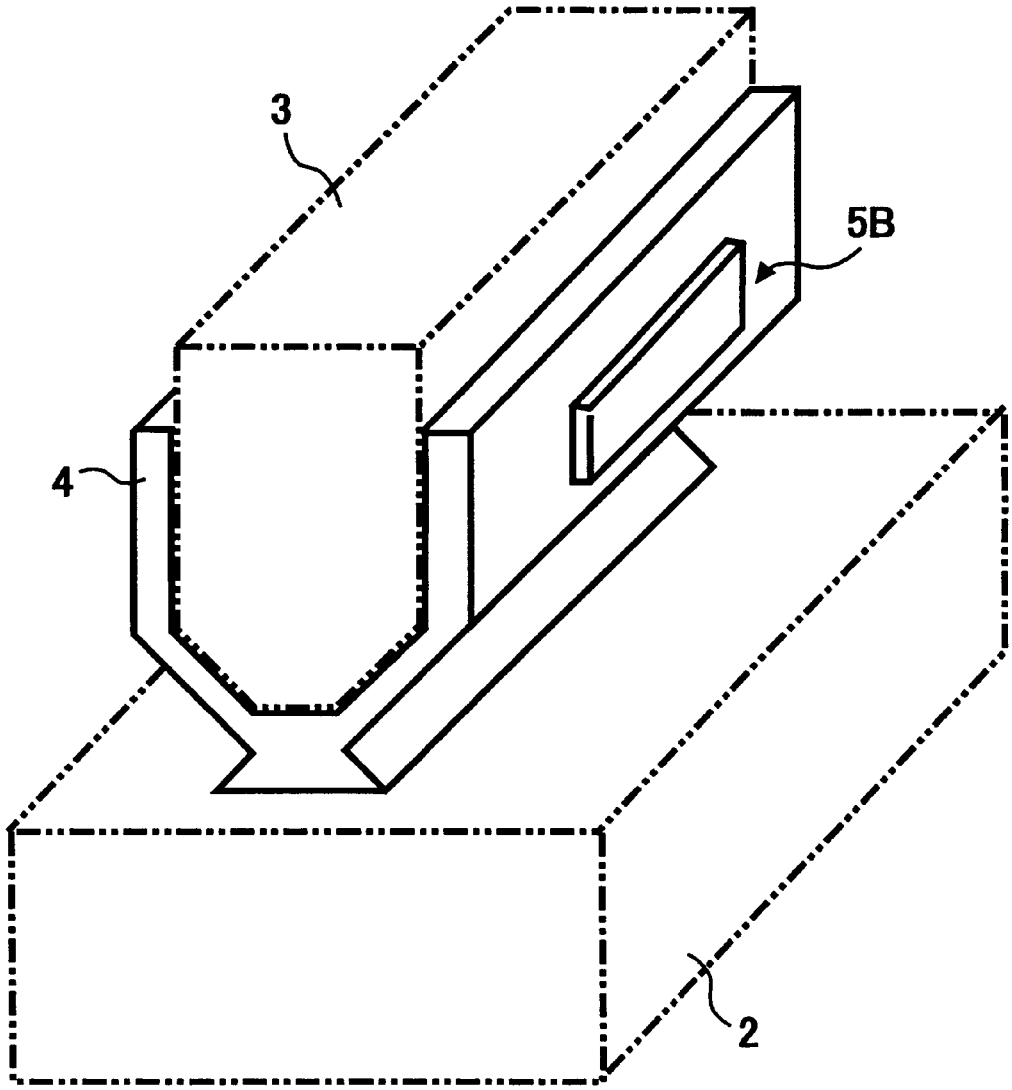
FIG. 6A is a schematic view illustrating the use of a piezoelectric element 5B as the vibration apparatus.
Figure 6B:
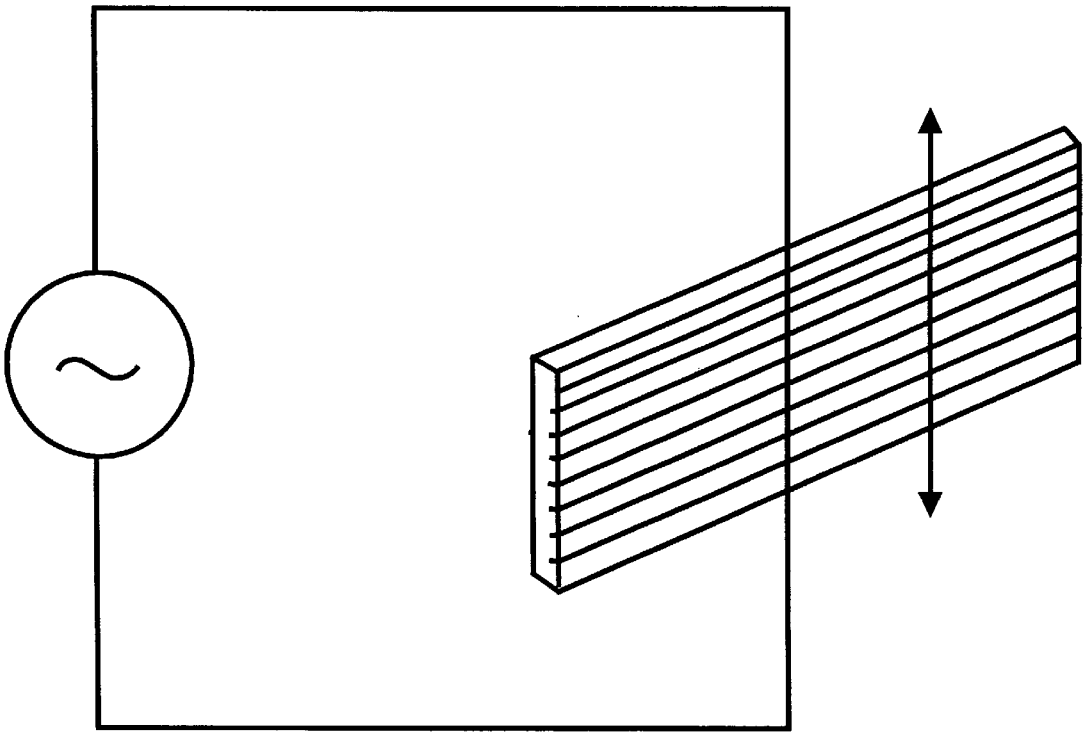
FIG. 6B is a diagram illustrating the vibration of the piezoelectric element 5B when a voltage is applied thereto.

FIG. 6A shows a piezoelectric element 5B used as the vibration apparatus 5. FIG. 6A is a perspective view showing the overall structure thereof. FIG. 6B is a diagram showing the state of the vibration of the piezoelectric element at the time of applying the AC or pulse voltage thereto. In FIG. 6A, the piezoelectric element 5B has a laminer structure and is fixed to the outer surface of the toner hopper. The laminating direction of the laminar structure is perpendicular to the outer surface of the toner hopper mounting part 4. The piezoelectric element vibrates as shown in FIG. 6B, and its vibration is transmitted to the toner hopper 3 through the toner hopper mounting part 4.

Figure 7:
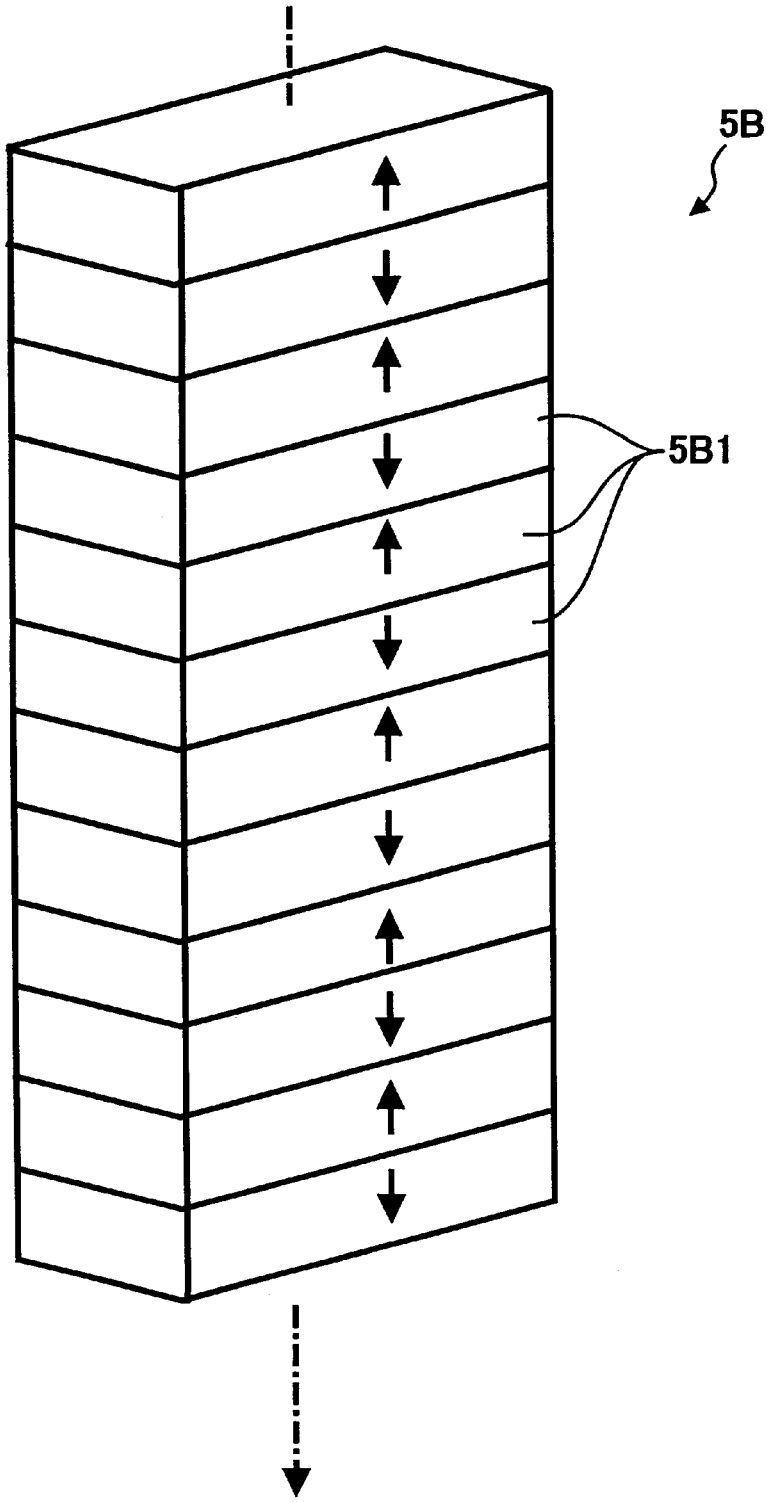
FIG. 7 is an enlarged schematic perspective view illustrating the structure of the piezoelectric element 5B shown in FIG. 6.

As shown in FIG. 7, the piezoelectric element 5B is constructed by laminating a plurality of the piezoelectric plates 5B1. The directions of the polarization of the adjacent piezoelectric plates 5B1 differ by 180° from each other. The respective piezoelectric plates 5B1 are electrically driven in parallel by an electric power source. The displacement of the piezoelectric plates may occur in the laminating direction. Assuming that the number of the laminations of the piezoelectric plates 5B1 is N, the applied voltage is V, and the multiplier (multiplying number) is $d_{33}$. The displacement x occurring on the piezoelectric element 5B having such shape can be represented by the following equation $$x=N\ d_{33}\cdot V.$$

Since the present embodiment adopts the structure as mentioned heretofore, the laminating direction of the piezoelectric element 5B is set to a direction perpendicular to the outer surface of the toner hopper mounting part 4. The piezoelectric element 5B is mounted on the outer wall surface thereof so as to be fixed thereon.

By applying the voltage to the piezoelectric plate 5B1, the displacement on the respective piezoelectric plates 5B1 occurs. Although the displacement amount of the piezoelectric plate 5B1 per one layer is very small, the displacement amount thereof can be increased in proportion to the number N of the laminations by adjusting the number N.

In particular, by inputting a pulse voltage to the laminated piezoelectric plates 5B1, the vibration can be altered by altering the frequency of the pulse.

According to the present invention, the fluidity of the toner can be optimized by changing the vibration frequency. In addition, the space for installing the vibration apparatus 5 required for that purpose can be reduced.

Figure 8:
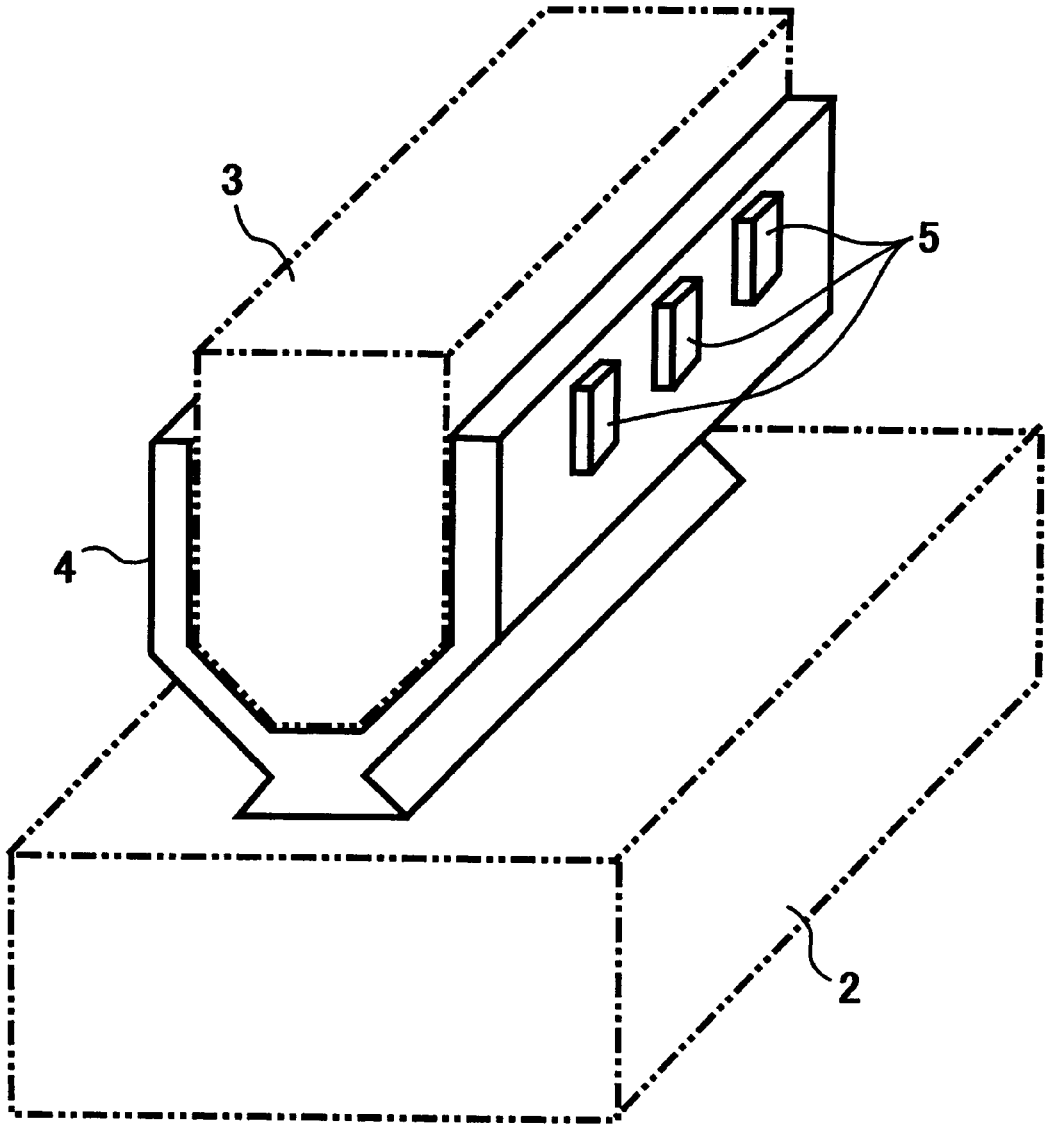
FIG. 8 is a schematic perspective view illustrating how a plurality of vibration apparatuses may be implemented with a single developing apparatus.

FIG. 8 illustrates how a plurality of vibration apparatuses 5 may be used with a developing apparatus. In FIG. 8, the vibration apparatuses 5 are installed to uniformly generate vibrations over the entire area of the outer surface of the toner hopper mounting part 4. By installing the vibration apparatuses 5 on plural positions of the outer surface of the toner hopper mounting part 4, the entire area of the outer wall surface thereof can be uniformly vibrated.

Since the present embodiment adopts the structure as mentioned heretofore, it is possible to apply the external force caused by the uniform vibration to the toner particles which may be in aggregate or solid form. Consequently, the state of the toner particles remain in a static state until the stress between the toner particles reaches a value greater than the adhesion force between the toner particles. In this manner, the toner particles are made to flow fluidly.

Furthermore, since the distance between the toner articles is widened by the vibrations, the positions of the toner particles can change, and the distance therebetween is widened to a distance in which the adhesion (or attraction) force between the toner particles is reduced. Thus, the toner particles can flow as mentioned above.

In particular, since a plurality of vibration apparatus 5 are installed on the overall area of the toner hopper mounting part 4 so as to enable vibrations to be transmitted to the entire area of the toner hopper 3 in which the toner is contained, the aforementioned fluidity property of the toner can be obtained throughout the entire toner containing part in the toner hopper 3.

Here, the vibration apparatuses 5, 5A, 5B are adjusted such that the relationship between the vibration applying frequency, fm, of the vibration apparatus itself and the inherent vibration frequency, fs, of the toner hopper mounting part 4 satisfies the following inequality $$(fm/\sqrt{2})<fs<(\sqrt{2}\cdot fm).$$

By setting such a relationship, even though a slight (very small) vibration applying force is generated in the vibration apparatuses 5, 5A, 5B in order to resonate the toner hopper mounting part 4, since the vibration can be effectively transmitted to the toner hopper 3, energy savings can be realized. In addition the fluidity of the toner in the toner hopper 3 can be secured.

Figure 9:
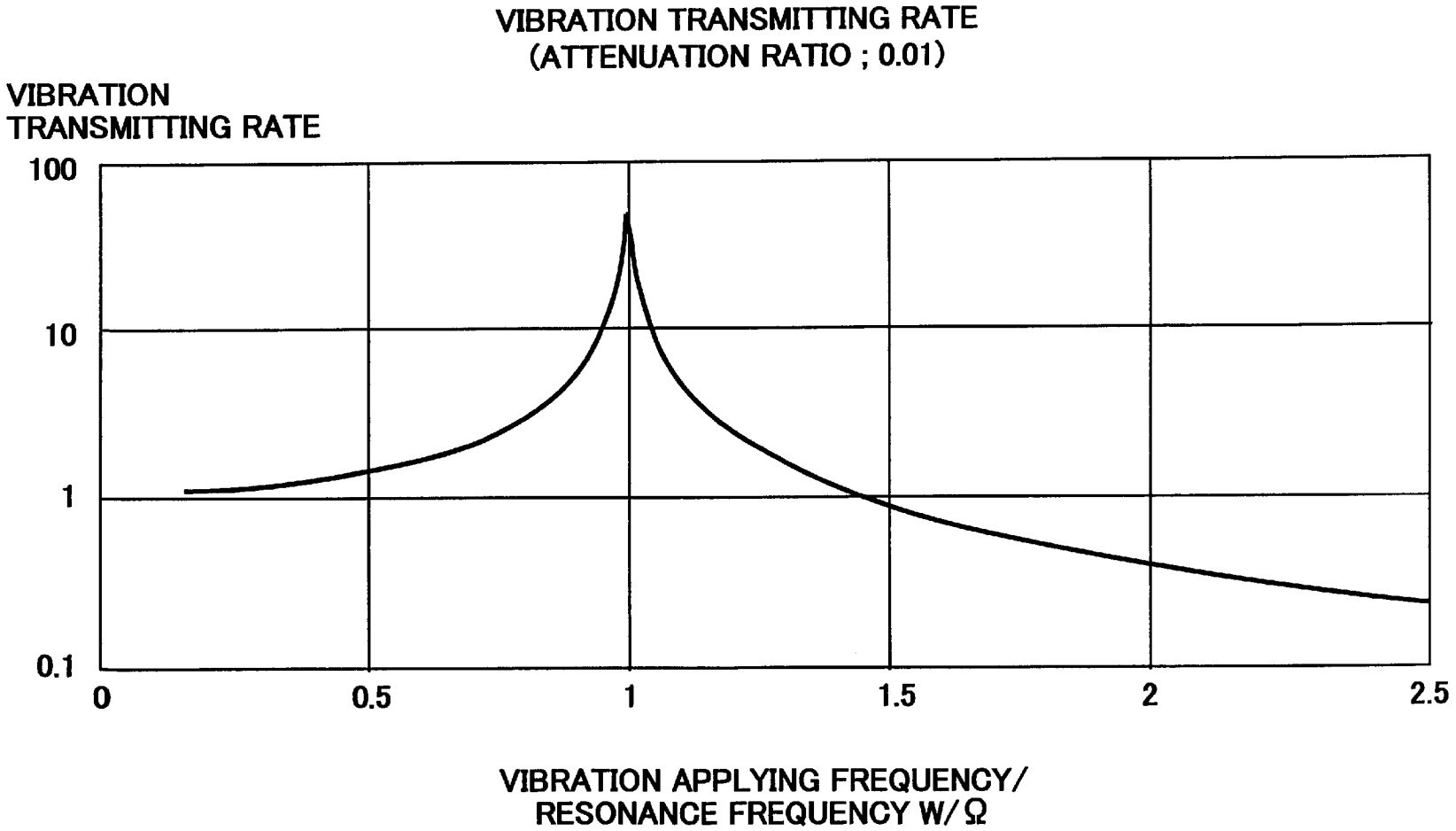
FIG. 9 is a graph explaining the vibration transmission rate on the basis of the relationship between the applied vibration frequency of the vibration apparatus and the inherent vibrations of the toner hopper.

FIG. 9 is a graph showing the vibration transmitting rate. FIG. 9 explains the vibration transmitting rate on the basis of the relationship between the vibration frequency of the vibration apparatus 5, 5A, 5B and the inherent vibration frequency of the toner hopper. In FIG. 9, when the ratio between the vibration applying frequency, fm, and the inherent vibration frequency of the toner hopper is equal to 1 (i.e., when both of the above values coincide with each other), the amplitude of the vibration reaches a maximum. Thereby, several hundred times the amplitude of the vibration applying can be obtained according to some attenuation ratio.

Furthermore, the relationship between the vibration applying frequency fm of the above-mentioned vibration apparatus and the inherent vibrations number, fh, of the toner hopper 3 satisfies the following inequality $$(fm/\sqrt{2})<fh<(\sqrt{2}\cdot fm).$$

Even by setting such a relationship in the developing apparatus, the toner hopper is resonated via the toner hopper mounting part 4. Thus, even though a slight (faint) vibration force exists, the toner hopper 3 can be effectively vibrated. Therefore, the toner in the toner hopper 3 can be prevented from remaining therein. In addition, to prevent clogging at the opening for exhausting the toner, the fluidity of the toner can be maintained using less energy. The relationship between the vibration frequency, fm, of the vibration apparatuses 5, 5A, 5B and the inherent vibration frequency, fs, of the toner hopper mounting part 4, and/or the inherent vibration frequency, fh, of the toner hopper 3 can be set by the control circuit of the structure shown in FIG. 10.

Figure 10:
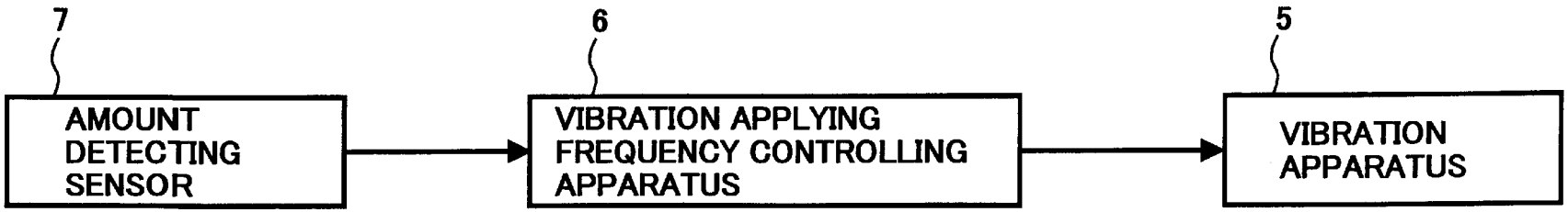
FIG. 10 is a block diagram showing how the applied vibration frequency of the vibration apparatus is changed.

FIG. 10 is a block diagram explaining the structure for setting the vibration frequency of the abovementioned vibration apparatus. In FIG. 10, the vibration apparatus (for convenience, the one represented by the reference numeral 5 is used) sets the vibration applying frequency in accordance with the signal received from the vibration applying frequency controlling apparatus 6. The vibration applying frequency controlling apparatus 6 sets the vibration applying frequency on the basis of the signal received from the toner amount detecting sensor 7. The toner amount detecting sensor detects the amount of toner contained in the toner hopper 3.

The vibration frequency controlling apparatus 6 changes the vibration frequency for resonating the toner hopper 3 at a maximum amplitude on the basis of the mass variation of the toner hopper 3, corresponding to the amount of the toner contained in the toner hopper 3. As the mass in the toner hopper changes, the newly set vibration applying frequency is output to the vibration apparatus 5.

Furthermore, it may be also possible to use an acceleration pickup capable of detecting the acceleration of the toner hopper 3 at the time of the vibration thereof instead of using the above-mentioned toner amount detection.

The image forming apparatus having the developing apparatus provided with the above-mentioned vibration apparatus is described hereinafter in detail. The image forming apparatus may be a color printer, for example, capable of forming a multiple-color image including a full-color image. Moreover, it is possible, as a matter of course, to use the image forming apparatus according to the present invention for electrophotographic copying devices such as a copying machine, facsimile device, etc.

FIG. 11 is a cross-sectional view showing the entire internal structure of an exemplary image forming apparatus. In FIG. 11, the color printer 100 is provided with an intermediate transfer belt 101 therein. The visible image for each of the respective colors formed on the photosensitive drum equipped in the image station is superposedly transferred onto the intermediate transfer belt 101. The image thus transferred onto the belt 101 is further transferred onto a sheet of the transfer paper P. The intermediate transfer belt 101 has a belt length which is longer than the movement direction length of the transfer paper P maximum size by the non-image area length including the detour (roundabout way) length of the respective rollers (discussed below).

The intermediate transfer belt 101 is suspended respectively on a driving roller 102 and a driven roller 103, both situated at both ends in the suspending direction and moved in the direction shown by an arrow in FIG. 11. In FIG. 11, the reference numeral 104 represents a tension roller of the intermediate transfer belt 101, and the reference numeral 101A represents a cleaning apparatus.

A density sensor detects the toner density on the upper suspending surface of the intermediate belt 101 and on the upper part of the driving roller 102. The density sensor detects the variation between the density of a standard density pattern and the density pattern formed on the intermediate transfer belt 101.

In FIG. 11 a first image station 105 and a second image station 106 are respectively arranged on the lower suspending surface of the intermediate transfer belt 101 at a predetermined interval along the suspending direction.

The first and second image stations 105 and 106 are respectively provided with photosensitive drums 107 and 107'. Developers (developing agents) for the dissolved colors and other developers for the complementary colors thereof are respectively supplied to the photosensitive drum. The development medium for supplying the developers is divided for each of the respective image stations, and the respective development media thus divided are installed in one lot (by the gross) per two colors which are half of the color dissolving number.

The first and second image stations 105 and 106 supply different developer colors to the photosensitive drum, but the structures of the image stations 105 and 106 are the same. Thus, only the structure of the first image forming station 105 is described.

The first image station 105 includes the elements for performing the electrophotographic process along the rotating direction of the photosensitive drum 107. These elements include a charging apparatus 108, a writing-in apparatus 109, a developing apparatus 110, a cleaning apparatus 111, and a transferring apparatus 112 opposite the photosensitive drum 107 through the intermediate transfer belt 101. The photosensitive drum 107 rotates in the direction shown by the arrow in FIG. 11.

The developing apparatuses 110 and 110' are provided for each of the respective colors in order to supply the developers of the colors corresponding to the complementary color of the color-dissolved colors. In the structure shown in FIG. 11, two-components-system developer is used for causing the carrier to carry the toner.

The developing apparatus 110 is constructed with a developing part provided with a developing sleeve 110A installed in the casing and opposing to the photosensitive drum 107 and an agitating paddle 110B; and a toner replenishing part having a conveying screw 110C situated in the neighborhood of the agitating paddle 110B and a toner replenishing part installed in the casing on the upper part of the conveying screw and capable of mounting thereon the toner hopper 3 shown in FIG. 1. The toner replenishing part is described below.

The agitating paddle 110B is provided with a spiral wing and a plurality of plates. The plates are arranged in a radial state in order to agitate the developer and convey the developer.

The conveying screw 110C is shaped as a spirally wound wing and rotates in the direction reverse of the agitating paddle 110B. Thus, the developer is conveyed in the reverse direction and the developer can be uniformly distributed in the axis direction of the developing sleeve 110A.

A roller-state transferring apparatus 113 opposing the driven roller 103 is disposed on a position passing through the second image station 106 in the movement direction of the intermediate transfer belt 101. The superposed image on the intermediate transfer belt 101 is transferred in gross onto the transfer paper P conveyed from the paper feeding apparatus. The timing of the paper feeding is set by the registration roller 114.

After the transfer paper P having the superposed image passes through the transfer position, the image is thermally fixed by a fixing apparatus 115 provided with a heating roller. Thereafter, the transfer paper P is discharged onto the paper discharging tray 117 through a paper discharging apparatus 116. An air exhausting fan 117A is provided in the image forming apparatus 100 shown in FIG. 11. The electric parts disposed under the paper exhausting tray 117 is not heated under the influence of the heat emitted from the fixing apparatus 115 by the action of the above air exhausting fan 117A. In FIG. 11 the reference numeral 115A represents the roller brought into direct contact with the roller at the heating side and applying the off-set preventing liquid thereto.

Figure 12:
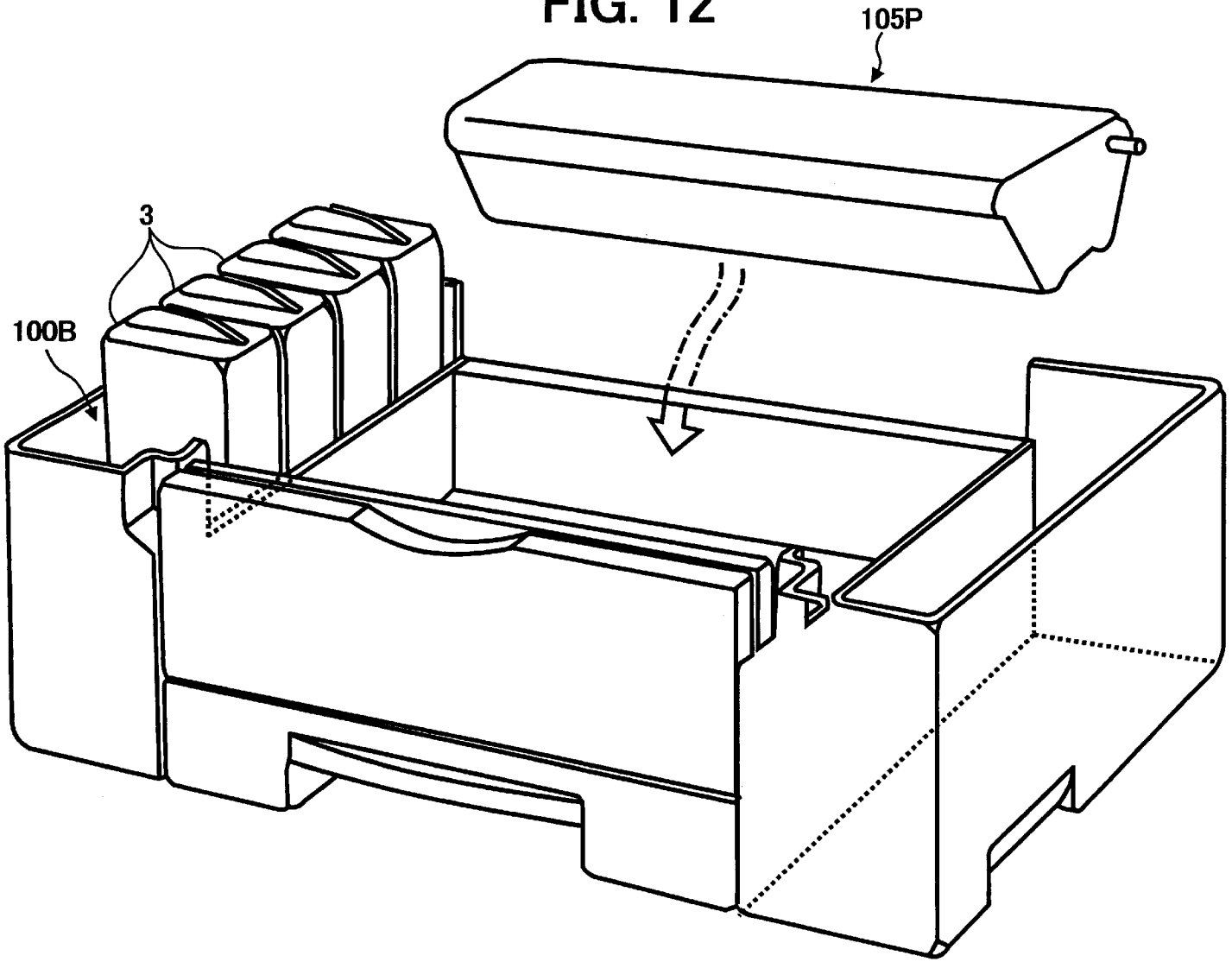
FIG. 12 is a perspective external view of image forming apparatus in FIG. 11 with the upper cover removed.
Figure 13:
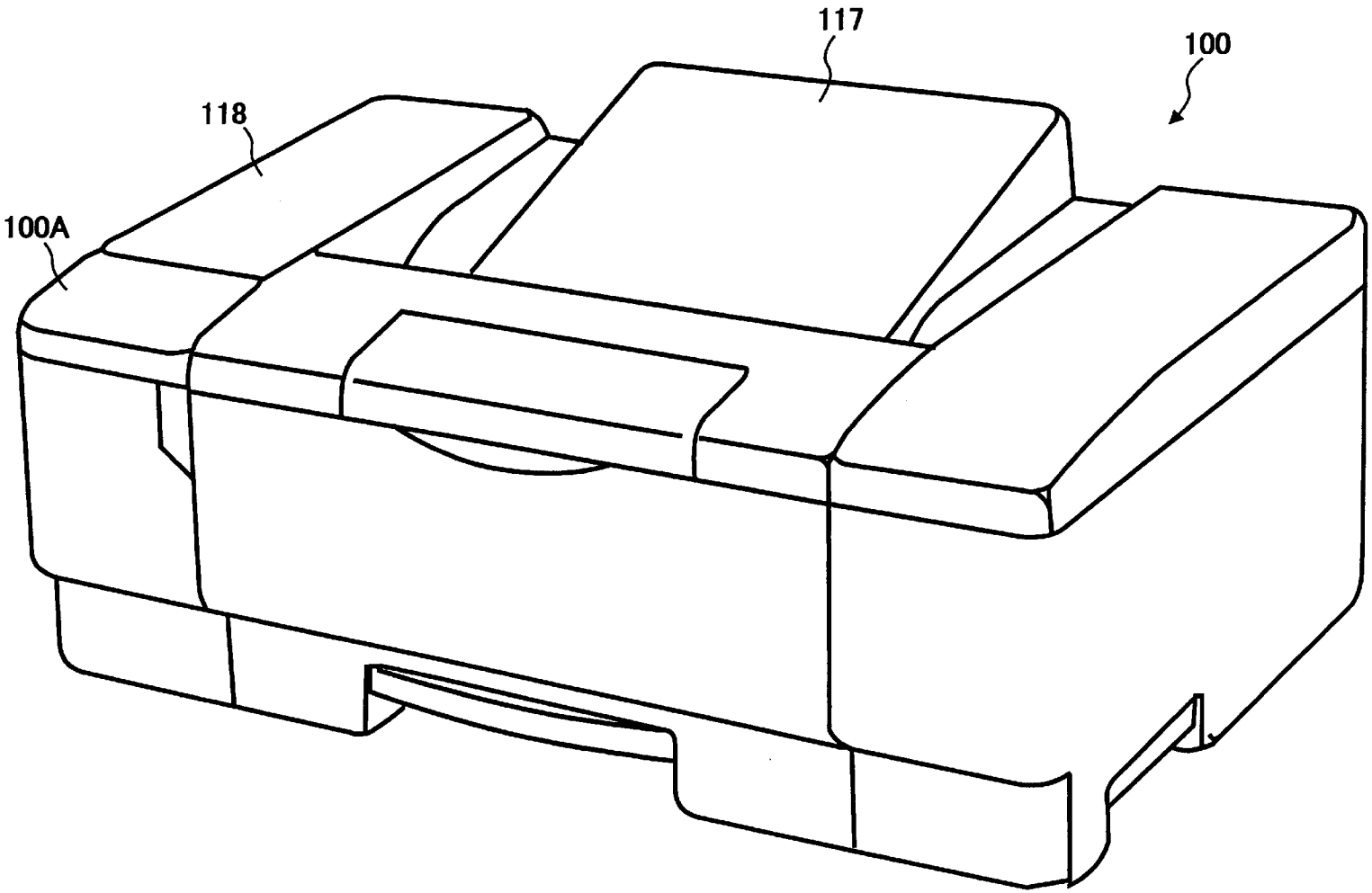
FIG. 13 is a perspective external view of the image forming apparatus in FIG. 11.
Figure 14:
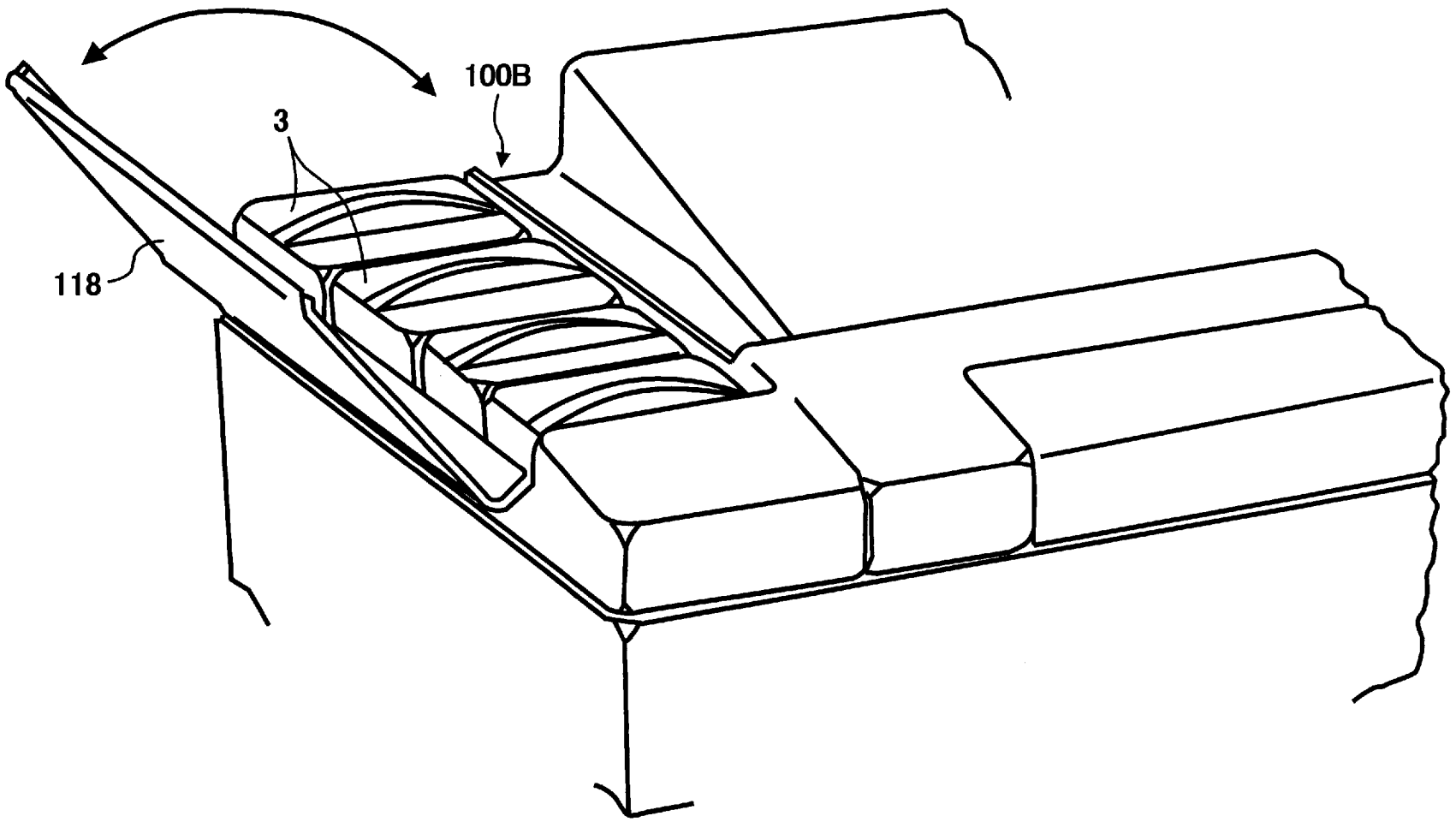
FIG. 14 is a partial perspective view of the toner replenishing parts of the image forming apparatus in FIG. 11.

FIGS. 12 through 14 respectively show the external appearance of the image forming apparatus including the toner replenishing parts of the developing apparatus with the covers in various states. The developing apparatus is disposed in a first space of a first opening portion of the image forming apparatus capable of being opened and closed by use of a first cover provided on the upper part of the main body of the image forming apparatus, each of the toner supplying media (or toner replenishing parts) for respectively supplying toner to the developing apparatus is disposed in a second space of a second opening portion capable of being opened and closed by use of a second cover also provided on the upper part of the main body of the image forming apparatus. Each of the toner supplying devices can be inserted into and taken away from the second opening portion of the image forming apparatus.

A toner hopper mounting part communicating with the space of the conveying screw 110 contained therein is provided in the toner replenishing part of the above-mentioned developing apparatus. The toner hopper mounting part is contained in a part of the casing of the apparatus main body as shown in FIG. 12.

FIG. 12 shows a main body with the cover 100A removed from the upper part of the housing of the image forming apparatus. An image forming unit 105P forming the first and second image stations 105 and 106 is detachably provided on the position adjacent to the toner hopper 3. For the convenience, only the unit in connection with the first image station is shown in FIG. 12.

As shown in FIG. 12, the toner hoppers 3 serves as the toner replenishing medium containing the toners of the colors consumed in the respective developing apparatuses. The toner hoppers 3 are arranged so as to be aligned in the housing portion of the image forming apparatus 100 corresponding to the toner hopper mounting part.

As shown in FIG. 12 and FIG. 14, an opening 100B for inserting and removing the toner hopper 3 is formed on the portion corresponding to the toner hopper mounting part in the housing of the image forming apparatus shown in FIG. 13. A cover member 118 capable of being opened and closed is provided at the opening 100B, as shown in FIG. 14.

The toner hopper 3 may be inserted into, and removed from, the opening 100B, and is provided in the toner replenishing part. The toner hopper 3 is supported by the structure shown in FIG. 15.

Figure 15:
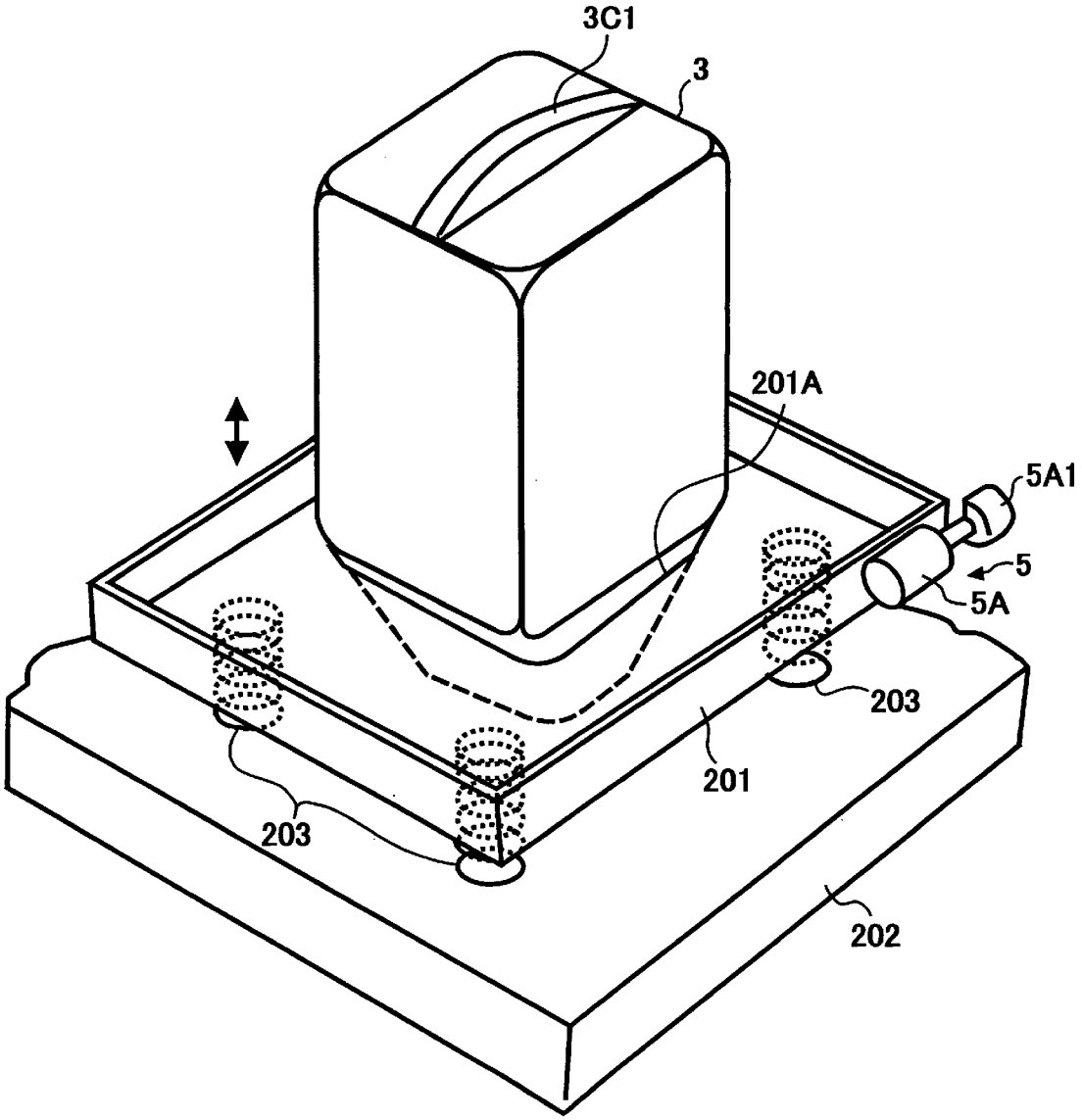
FIG. 15 is a perspective view of a toner replenishing part.

FIG. 15 is an explanatory perspective view for explaining the operation and the structure of the toner replenishing part shown in FIG. 14. In FIG. 15, the toner hopper 3 is supported by a supporting member 201 provided in the toner hopper mounting part and by detachably inserting and removing the tip end of the supporting member 201 having a toner exhausting opening in the bored portion 201A thereof.

The supporting member 201 is constructed with a housing formed so as to open the upper surface thereof supported on the base plate 202 provided in the floating state in the toner hopper mounting parts. The toner hopper mounting parts are mounted corresponding to the respective developing apparatuses through the coil spring 203 serving as an attenuating member.

The vibration apparatus 5 provided with the motor 5A shown in FIG. 4 is mounted on a part of the side wall of the supporting member 201. The vibration apparatus 3 can change the vibration applying intensity for each of the respective developing apparatuses. In such structure, in the case of increasing the toner replenishing speed and employing the toners of the plural colors at the same time, the replenishment of the insufficient toner can be promptly performed, and thereby the quality of the image can be prevented from lowering.

The vibration apparatus 5 is mounted to induce lengthwise (vertical) vibration in the direction shown by the arrow in FIG. 15, i.e., such that the weight 5A1 can rotate in the vertical plane. In such structure, the vertical vibration of the supporting member 201 is induced and thereby the toner hopper 3 can be vibrated in the vertical direction.

When the vibration is induced in the toner hopper 3, since the vibration of the supporting member 201 is buffered (absorbed) by the coil spring 203, the vibration is not transmitted to the supporting member 201.

Figure 16:
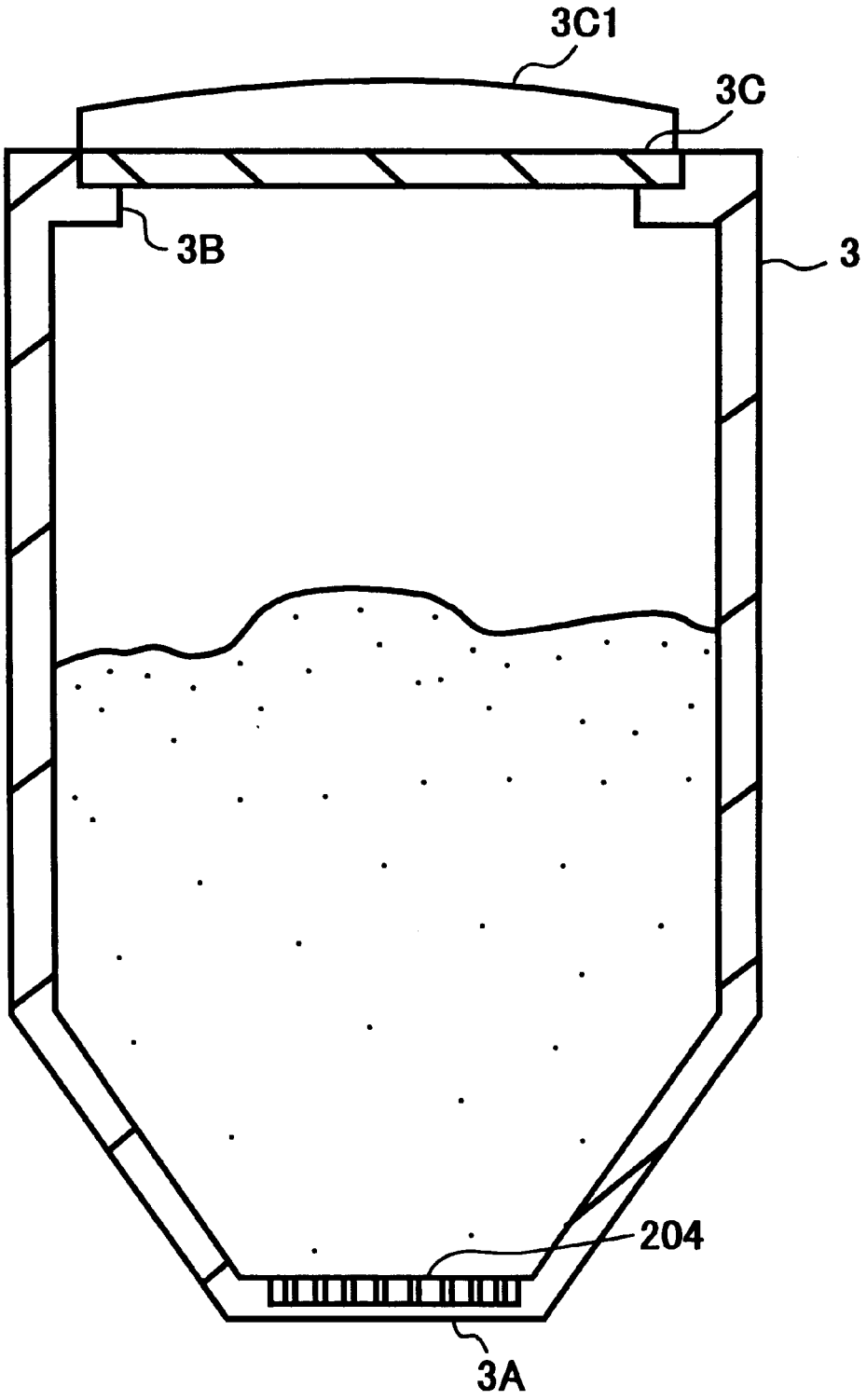
FIG. 16 is a cross-sectional view of the toner hopper serving as the toner supplying device in the toner replenishing part in FIG. 15.

As shown in FIG. 15 and FIG. 16, the toner hoppers 3 are formed in the same almost rectangular shape. The toner hopper 3 has a male tip end portion to be inserted into the female bored portion 201A of the supporting member 201. A toner exhausting opening 3A (FIG. 16) is formed on the tip end portion of the toner hopper 3. Furthermore, the toner hopper 3 is constructed with a semitransparent or transparent container. Therefore, it is possible to view the amount of the toner contained in the container. In addition, since the tip end portion of the toner hopper 3 is shaped as a right pyramid or circular cone, the falling toner can be funneled into the toner exhausting opening 3A.

As shown in FIG. 16, a mesh-member 204 having a mesh size of 50 to 500 $\mu$m is provided as the toner-supply controlling member on the toner exhausting opening 3A of the toner hopper 3.

A replenishment opening 3B is formed on the bottom portion at the opposite side of the tip end portion of the toner hopper 3. A cap 3C is detachably mounted on the replenishment opening 3B. When a grasping portion 3C1 unitarily provided on the cap 3C is grasped and the cap 3C is removed from the replenishment opening 3B, the toner hopper 3 can be replenished with new toner.

When the vibration does not occur, the toner contained in the toner hopper 3 is solidified under the force of gravity and becomes a static toner mass. However, by inducing the lengthwise (vertical) vibration, the vibration is applied to the toner mass at the same time when the vibration apparatus 5 initiates vibration. In such state, the distance between the toner particles is widened to the extent (distance) that the adhesive force is not exerted on each other between the toner particles. As the result, the toner particles can move freely.

In particular, since the vibration apparatus 5 vibrates lengthwise (vertically), the separated toner may fall freely under its own weight. In addition, the fallen toner is collected on the toner exhausting opening 3A owing to the right pyramidal or conical shape of the tip end of the toner hopper 3. Only separated toner particles can be easily exhausted from the toner exhausting opening 3A through the mesh member 204.

The mesh member 204 does not permit the solidified toner in the mass state to pass therethrough. The member 204 permits only the separated toner particles to pass therethrough. With the mesh structure 204, the toner mass and the toner particles can be separated, and thereby the supply of the toner can be controlled.

In the case of forming a full-color image, electrostatic latent images are formed for each of the respective color-dissolved colors on the photosensitive drums 107 and 107' by use of the writing apparatus 109. The electrostatic latent images are converted to the visible images by the respective developing apparatuses.

In the image forming apparatus 100 in FIG. 11, until the processed visible image on the intermediate transfer belt 101 arrives at the transfer positions respectively provided in the first image station 105 and the second image station 106, the image of the color different from that of the image formed in the first image station 105 is formed in the second image station 106. Thereafter, the image thus formed is superposedly transferred onto the intermediate transfer belt 101.

Regarding the method of transferring the image to the intermediate belt 101, the following two methods may be implemented:

(1) The visible images of the first color and the second color respectively formed in the first and second image stations 105 and 106 are superposedly transferred in order onto the intermediate transfer belt 101 at the time of the first rotation of the belt 101.

The visible images of the third color and the fourth color respectively formed in the first and second image stations 105 and 106 are superposedly transferred in order onto the previously transferred image of the above-mentioned first and second colors formed on the intermediate transfer belt 101 at the time of the second rotation of the belt 101. Thereafter, those four superposedly transferred images are transferred in gross onto the transfer paper P.

(2) The image of the same color as that of the first color previously transferred, namely, the image of the color corresponding to the first color is transferred once again, in the first image station 105, on the new surface of the moving intermediate transfer belt 101, on which the visible image of the second color formed in the second image station 106 is superposedly transferred onto the visible image of the first color formed in the first image station 105. Next, when the previously transferred image of the first color arrives at the second image station 106, the image of the second color is superposedly transferred thereon. Following this step, when the image of the first color transferred once again arrives at the second image station 106, the visible image of the second color is superposedly transferred onto the image of the first color. Then, when the image previously superposedly transferred in the first and second image stations 105 and 106 arrives once again at the first image station 105 after one rotation of the intermediate transfer belt 101, the visible image of the third color is transferred onto the superposedly transferred image in the first image station 105. Thereafter, successively, the visible image of the fourth color is transferred onto the superposedly transferred image in the second image station 106.

The above-mentioned superposedly transferred image is further transferred in gross onto the transfer paper P.

Furthermore, following the step of transferring the image in gross onto the transfer paper, when the superposedly transferred image of the first and second colors arrives at the first image station 105 in accordance with the movement of the intermediate transfer belt 101, the image of the third color is superposedly transferred thereto in the first image station 105, and the image of the fourth color is superposedly transferred thereto in the second image station 106. The image thus transferred is further transferred in gross onto the transfer paper P.

In the case of method (1), the images of the different colors are superposedly transferred once for each rotation of the intermediate transfer belt 101, while, in the case of method (2), the image of the color previously transferred is transferred once again in the first and second image stations 105, 106 during the time period when the intermediate transfer belt 101 rotates by half rotation (180°), and the images of the same color are successively transferred. According to method (1), the visible image which is superposedly transferred when the intermediate transfer belt 101 rotates twice is further transferred in gross onto the transfer paper P.

On the other hand, according to method (2), the visible image which is superposedly transferred when the intermediate transfer belt 101 rotates one-and-a-half times (540°) is transferred in gross onto the first transfer paper P, and the visible image is transferred onto the second transfer paper P in the delayed state in the intermediate transfer belt 101 until the image forming area to be treated with one-time transferring in the gross. Therefore, the transferred image is further transferred in the gross onto the transfer paper when the intermediate transfer belt 101 rotates two-and-a-half times, corresponding to the shift of the transfer position between the first and second image stations 105 and 106. The method of the item (2) is effective in shortening the image forming time when a plurality of transferred objects (e.g., copied sheets) have to be obtained.

When the density of the toner images of the respective colors on the intermediate transfer belt 101 is low or the amount of the toner in the respective developing apparatuses is low, the toner is replenished from the toner replenishing part. When this occurs, the vibration apparatus begins to vibrate and thereby the lengthwise (vertical) vibration is induced in the toner hopper mounting part. The vibration applying time is set to occur at a time other than the time of forming the image onto the photosensitive drum 107 such that the vibration is not unexpectedly transmitted to the developing apparatus side when the image is formed.

The transmission of such vibration can be prevented by the buffering action of the coil spring 203 disposed between the supporting member 201 and the base plate 202. Thus, the vibration is not transmitted to any one of the toner hoppers 3 (except for the one for replenishing the toner), all of which are installed in the toner replenishing part.

When the lengthwise (vertical) vibration from the vibration apparatus 5 is induced on the supporting member 201 of the toner hopper mounting part, the toner hopper 3 vibrates in the lengthwise (vertical) direction and the toner contained in the toner hopper 3 also vibrates. Thus, the toner particles solidified in a mass are separated into pieces by the vibration between the respective toner particles and enabled to easily slip down in the toner hopper. The toner particles arrive at the toner discharging opening 3A of the toner hopper 3. At the opening 3A, only the toner particles of the size corresponding to the mesh size of the mesh member 204 pass through the mesh member 204 and are discharged therefrom.

When the vibration of the toner hopper 3 stops, the toner in the toner hopper 3 is accumulated by the empty weight thereof in the circumferential portion of the toner exhausting opening 3A and solidified in a mass. At this time, since the size of the solidified toner becomes larger than that of the individual toner particles and the mesh size of the mesh member 204, the toner mass cannot pass through the mesh member 204. As a result, the toner accumulates in the toner hopper 3. Since the toner hopper 3 is a transparent or semitransparent container, the state of the toner in the toner hopper 3 can be confirmed by observing the toner from outside the toner hopper 3. When the toner is not in a predetermined state, the toner hopper can be easily exchanged, or the toner can be easily replenished.

Since the shape of the toner hopper 3 is the same as the shape applicable to the toner replenishing part of the respective developing apparatuses, the toner hopper can be used for recycling. The toner hopper is formed in the shape of a square column. Therefore, the amount of toner contained can be maximized. As a result, the replenishment cycle of the toner can be made long. Thus, the troublesome work of maintenance, etc. can be reduced or eliminated. Furthermore, since the toner hopper 3 has a tip end portion of the toner exhausting opening 3A formed in the shape of a pyramid, the toner separated into particles out of the toner mass can easily slip down in the toner hopper 3. Thus, the toner can be successively exhausted from the toner exhausting opening 3A. Consequently, the toner can be promptly replenished.

The toner exhausting opening 3A of the toner hopper 3 permits only toner particles to pass therethrough and controls the toner supply by providing the mesh member 204 at the opening 3A. However, according to the present invention, it is also possible to control the toner exhaust by optionally opening and closing the toner exhausting opening.

Figure 17A:
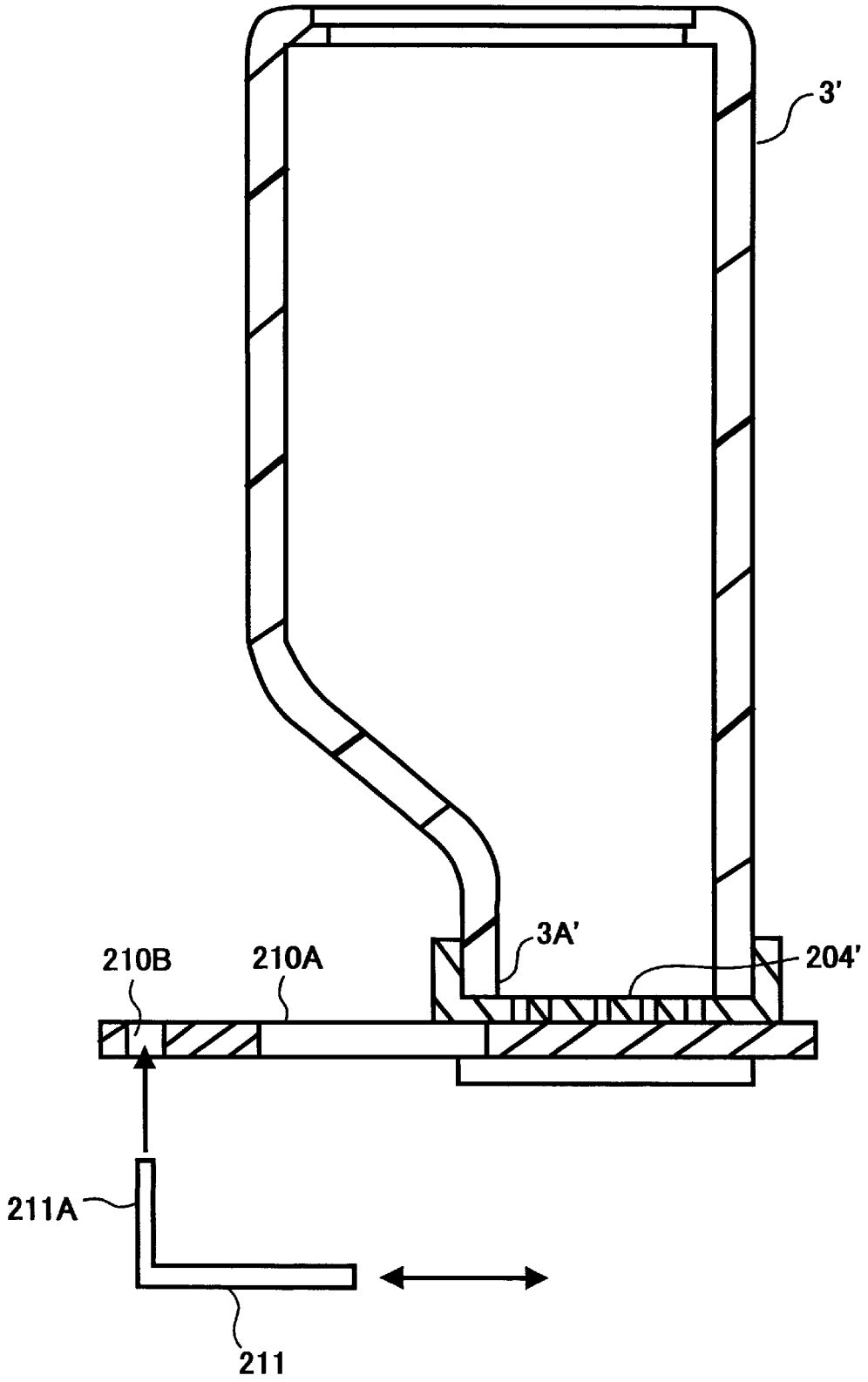
FIG. 17A is a cross-sectional view of a modified toner hopper.
Figure 17B:
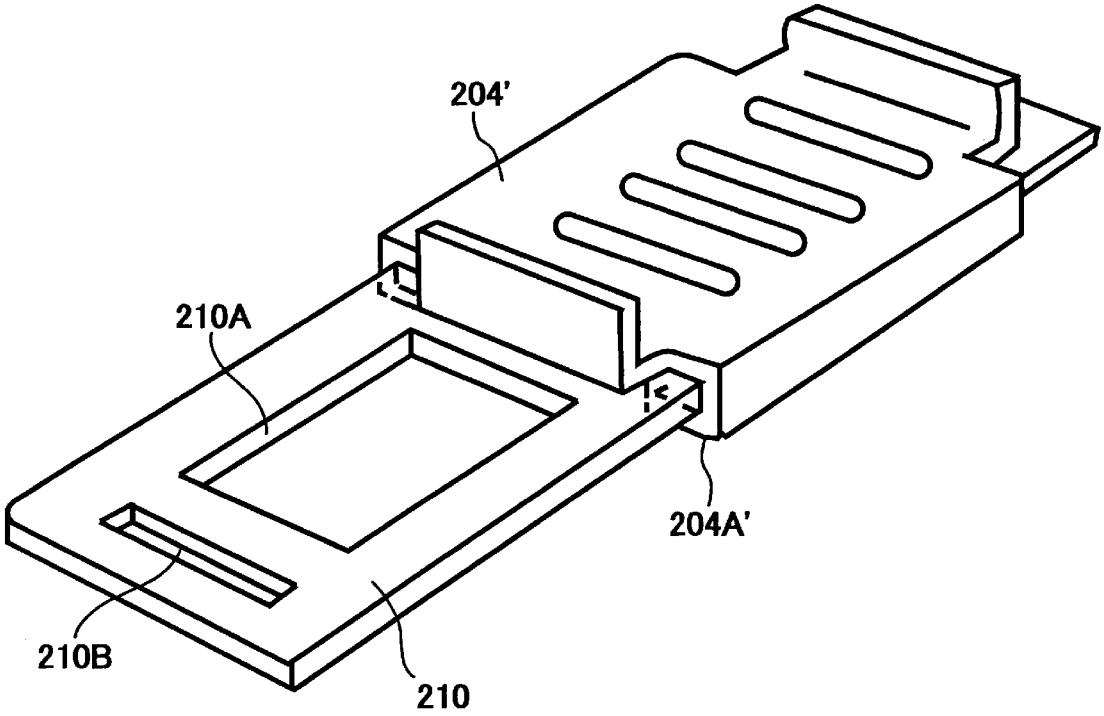
FIG. 17B is a perspective view of a shutter member 210 of the toner hopper.

As shown in FIG. 17, at the toner exhausting opening there is provided a shutter member 210 capable of opening and closing the toner exhausting opening. At the toner exhausting opening 3A' of the toner hopper (for convenience, represented by the reference numeral 3'), there is provided a mesh member (for convenience, represented by the reference numeral 204') having a plurality of slits or narrow openings instead of the mesh member 204. Furthermore, in the vicinity of the mesh member 204', there is provided a shutter member 210 capable of sliding in across the mesh member 204'. Sliding the shutter member 210 narrows the slits to a size that permits only toner particles to pass therethrough as in the case of the mesh member 204 described in the above embodiment.

The shutter member 210 is constructed with a plate member having an opening 210A formed thereon capable of exposing the entire area of the opening of the mesh member 204'. The shutter member 210 is tightly (or fixedly) inserted into and slidably supported by a supporting piece 204A' constructed with a bent piece formed on the mesh member 204'.

A stop hole 210B constructed with an opening is formed on one end of the shutter member 210 in the sliding direction. A stop piece 211*a* of the driving member 211 for sliding the shutter member 210 is tightly inserted into the stop hole 210B. The driving member 211 is slidably provided at the base plate 202 side of the toner hopper mounting part. An operating piece capable of being operated from the outside is formed on a portion of the driving member 211. The operating piece is connected to a driving medium, such as a solenoid, and the operating piece can slide thereon.

The solenoid is energized when the vibration starts due to the operation of the apparatus 5. At this time, the stop piece 211A is pulled or pushed, and thereby the opening 210A of the shutter member 210 and the slit in the mesh member 204' communicate with each other. On this occasion, the solenoid serving as the driving member sets the position of the driving member 211 such that the opening 210A of the shutter member 210 does not communicate with the slits of the mesh member 204' when the solenoid is not energized. The opening of the mesh member 204' communicates with the opening 210A of the shutter member 210 when the solenoid is energized, as mentioned above.

Even though the vibration by the vibration apparatus 5 stops, when the toner hopper 3 vibrates by the action of the inertia force, the careless exhaust of the toner particle can be prevented. Thus, the excessive replenishment of the toner can be also prevented. Consequently, the proper amount of toner is replenished, and thereby the image density can be prevented from varying greatly.

As is apparent from the foregoing description of the embodiments according to the present invention, many advantageous functional effects as mentioned below can be attained. The vibration apparatus is provided in the toner hopper mounting part. The vibration is not applied to the toner exhausting opening. Instead, the vibration is applied to the entire portion of the toner hopper supported by the toner exhausting opening. In such structure, since the toner particles contained in the toner hopper can be mutually vibrated, it is possible to obtain the preferred fluidity of the toner over the entire area in the toner hopper. Thus, the toner can be prevented from solidifying and remaining in the exhausting opening. Furthermore, since a vibration apparatus is provided for the toner hopper mounting part, the toner hopper can be easily exchanged. In addition, it is not necessary to perform the troublesome work of individually installing the vibration apparatus for the exchanged toner hopper on all such occasions. Consequently, the exhausting property of the toner can be improved with the simple structure, and the clogging can be surely prevented.

According to the present invention, further advantageous effects as mentioned below can be attained. By applying the vibration of low noise and comparatively low frequency, the toner can be prevented from being consolidated by ramming and the preferable fluidity of the toner can be secured. The vibration applying force can be controlled by controlling the applied voltage, and therefore, the degree of fluidity (i.e., fineness) of the toner can easily be set. A uniform vibration can be caused over the entire area of the toner hopper, and therefore, almost all of the toner in the toner hopper is vibrated and the fluidity of the toner can be improved. Thus, the occurrence of unused toner can be reduced or eliminated. Even though the output of the vibration apparatus is reduced, the fluidity of the toner can be effectively maintained, and therefore, energy savings can be realized. Furthermore, even though the output of the apparatus is reduced, the toner hopper can be effectively resonated, and thus, the fluidity of the toner can be effectively secured. The density unevenness of the image developed on the photosensitive body and the occurrence of the density unevenness can be prevented with little energy. In addition, the low noise can be attained, resulting in the reduction of noise pollution.

When plural developing apparatuses are employed to form the image, the toner can be replenished for each of the respective developing apparatuses. Furthermore, the toner hopper employed for the toner replenishment can be commonly used for the respective developing apparatuses. In addition, both of the confirmation of the toner level and the replenishment of the toner are possible. Therefore, the recycling property of the member employed for the toner replenishing part is enhanced, and thus, the maintenance cost can be reduced in the case of employing plural developing apparatuses. Furthermore, by setting the vibration mode of the vibration apparatus to generate vertical vibration, when the solid toner mass is separated into the toner particles, the toner can easily slip down in the hopper. Thus, the toner can be successfully exhausted. Consequently, the toner can be promptly replenished.

The vibration is caused by the vibration apparatus does not occur during image formation, and the vibrations are not mutually transmitted to each other between the plural developing apparatuses. Consequently, the adverse effects of vibration on the image formation can be avoided. In particular, at the time of forming the color image, the superposing transfer to the intermediate transfer body from the photosensitive body is performed. Therefore, the quality of the image can be prevented from being lowered, without causing the shift of the transferring position due to the vibration. The vibration applying intensity of the vibration apparatus can be changed for each of the respective colors. The replenishing time is shortened for the toner of the color to be replenished by large volume, and thus the toner can be promptly replenished.

The toner supply controlling medium having a mesh prevents the solid toner mass from passing through the exhausting opening and permits only small, separated toner particles to pass through the mesh member and be exhausted therefrom. Consequently, the exhausted and replenished toner can be easily and uniformly dispersed. Thus, the dispersion density of the toner to be supplied to the photosensitive body from the developing apparatus can be made uniform. Consequently, the image quality can be prevented from deteriorating.

A control unit (e.g., the vibration applying frequency controlling apparatus 6 in FIG. 10) may be used to receive inputs from a user and/or any of the sensors described above to control the various functions of the developing apparatus and/or the image forming apparatus of the present invention. The control unit preferably includes an appropriately programmed microprocessor and a memory for storing information, such as the predetermined toner density values discussed above. Thus, the control unit can be implemented to control the operation of the vibrating apparatus, as well as perform processing for any the various functions of the developing unit and image forming apparatus described above.

In describing preferred embodiments of the present invention illustrated in the drawings, specific terminology is employed for the sake of clarity. However, the present invention is not intended to be limited to the specific terminology so selected and it is to be understood that each specific element includes all technical equivalents which operate in a similar manner.

Obviously, other numerous embodiments or numerous modifications of the present invention are possible in light of the above teachings. It is therefore to be understood that, within the scope of the appended claims, the invention may be practiced otherwise than as specifically described herein.

This application is based on Japanese Patent Application No. JPAP10-125,505, filed on May 8, 1998, and another Japanese Patent Application No. JPAP10-349,526, filed on Dec. 9, 1998. JPAP10-125,505 and JPAP10-349,526, and all references cited therein, are incorporated herein by reference.

What is claimed as new and desired to be secured by Letters Patent of the United States is:

1. A developing apparatus for supplying toner to a latent image carried on a latent image carrier and converting the latent image to a visible image with the toner, comprising:

a toner hopper configured to hold unused toner;

a developing tub; and a toner hopper mounting part provided between the developing tub and the toner hopper, said toner hopper being adapted to be mounted to and removed from said toner hopper mounting part, said toner hopper mounting part including a vibration apparatus;

wherein said vibration apparatus comprises: a motor including a rotation shaft; and an eccentric part formed on the rotation shaft of said motor; and wherein the frequency of vibration applied by the vibration apparatus, fm, and the inherent vibration frequency of the toner hopper mounting part, fs, satisfy the following inequalities:

$$fm/\sqrt{2}<fs<\sqrt{2}\cdot fm.$$

2. A developing apparatus for supplying toner to a latent image carried on a latent image carrier and converting the latent image to a visible image with the toner, comprising:

a toner hopper configured to hold unused toner;

a developing tub; and a toner hopper mounting part provided between the developing tub and the toner hopper, said toner hopper being adapted to be mounted to and removed from said toner hopper mounting part, said toner hopper mounting part including a vibration apparatus;

wherein the frequency of vibration applied by the vibration apparatus, fm, and the inherent vibration frequency of the toner hopper, fh, satisfy the following inequalities:

$$fm/\sqrt{2}<fh<\sqrt{2}\cdot fm.$$

3. The apparatus of claim 2, wherein the frequency of vibration applied by the vibration apparatus, fm, is controllably variable.

4. An image forming apparatus, comprising:

a latent image carrier configured to carry a latent image;

a first developing apparatus configured to supply toner to the latent image carried on the latent image carrier and convert the latent image to a visible image with the toner, said first developing apparatus including a first toner hopper configured to hold unused toner, a developing tub, and a toner hopper mounting part provided between the developing tub and the first toner hopper, said first toner hopper being adapted to be mounted to and removed from said toner hopper mounting part, said first toner hopper mounting part including a first vibration apparatus;

a control unit configured to cause the first vibration apparatus to vibrate such that the first toner hopper resonates when a standard density pattern on the latent image carrier is equal to or less than a predetermined value so that the unused toner in said first toner hopper flows from said first toner hopper through said first toner hopper mounting part to supply said latent image carrier with toner;

a main body;

a first cover on an upper portion of the main body, said cover being configured to be opened and closed over a first portion of an opening defined by the upper portion of the main body, said first developing apparatus being disposed in a first space within said opening; and a second cover configured to be opened and closed over a second portion of the opening and to cover toner supplying devices disposed in a second space within said opening, said toner supplying devices being detachable from said image forming apparatus and configured to supply toner to the first developing apparatus.

5. The apparatus of claim 4, further comprising:

a plurality of vibration apparatuses including said first vibration apparatus, said vibration apparatuses corresponding to the plurality of developing apparatuses, said control unit being configured to change the vibration intensity of the vibration apparatuses independently of one another.

6. The apparatus of claim 4, wherein the first vibration apparatus is configured to initiate lengthwise vibration along said first toner hopper.

7. The apparatus of claim 6, wherein the control unit is configured to initiate the vibration of the first vibration apparatus only at times when an image is not being formed.

8. The apparatus of claim 4, wherein said toner hopper comprises:

a cap configured to be opened and closed so the toner hopper may be replenished with unused toner.

9. The apparatus of claim 4, wherein said toner hopper comprises:

an end having a conical shape forming a tip portion defining an opening in the end of said toner hopper; and a toner supply controlling device in the opening in the end of the toner hopper, said toner supply controlling device being configured to regulate the amount of toner that flows through the opening in the end of the toner hopper.

10. The of claim 9, wherein said toner supply controlling device comprises:

a mesh having a mesh size of 50 to 500 micrometers.

11. The apparatus of claim 4, wherein the first vibration apparatus is configured to initiate lengthwise vibration along said first toner hopper.

12. The apparatus of claim 11, wherein the control unit is configured to initiate the vibration of the first vibration apparatus only at times when an image is not being formed.

13. The apparatus of claim 4, wherein the control unit is configured to initiate the vibration of the first vibration apparatus only at times when an image is not being formed.

14. The image forming apparatus of claim 4, wherein the toner hopper is formed of a material selected from the group consisting of: a semi-transparent material and a transparent material.

15. The apparatus of claim 4, wherein said toner hopper comprises:

a cap for opening and closing the toner hopper.

16. An image forming apparatus, comprising:

a latent image carrier configured to carry a latent image;

a first developing apparatus configured to supply toner to the latent image carried on the latent image carrier and convert the latent image to a visible image with the toner, said first developing apparatus including a first toner hopper configured to hold unused toner, a developing tub, and a toner hopper mounting part provided between the developing tub and the first toner hopper, said first toner hopper being adapted to be mounted to and removed from said toner hopper mounting part, said first hopper mounting part including a first vibration apparatus;

a control unit configured to cause the first vibration apparatus to vibrate such that the first toner hopper resonates when a standard density pattern on the latent image carrier is equal to or less than a predetermined value so that the unused toner in said first toner hopper flows from said first toner hopper through said first toner hopper mounting part to supply said latent image carrier with toner;

a main body;

a cover on an upper portion of the main body, said cover being configured to be opened and closed over a first portion of an opening defined by the upper portion of the main body, said first developing apparatus being disposed in a first space within said opening; and at least one toner supplying device in the opening, said toner supplying device being configured to supply toner to the developing apparatus and to be detached from the opening.

17. A method for supplying toner in an image forming apparatus, comprising the steps of:

storing unused toner in a toner hopper;

fixing the toner hopper on a toner hopper mounting part such that the toner hopper communicates with a developing tub through the toner hopper mounting part; and vibrating the toner hopper mounting part with a vibration apparatus mounted to said toner hopper mounting part;

wherein the vibration apparatus includes a piezoelectric element and the step of vibrating comprises the step of: vibrating the toner hopper mounting part with the piezoelectric element; and wherein the vibrating step comprises the step of: vibrating the toner hopper mounting part in accordance with the following inequalities:

$$fm/\sqrt{2}<fs<\sqrt{2}\cdot fm$$

where fm is the frequency of vibration of the vibration apparatus and fs is the inherent vibration frequency of the toner hopper mounting part.

18. The method of claim 17, further comprising the step of:

controlling the frequency of vibration of the vibration apparatus.

19. The method of claim 17, further comprising the step of:

determining whether a density of a standard density pattern on the latent image carrier is equal to or less than a predetermined density; and wherein the step of vibrating further comprises the step of:

resonating the toner hopper with the toner hopper mounting part when the density of the standard density pattern is equal to or less than the predetermined density.

20. The method of claim 19, further comprising:

controlling the vibration apparatus so that the vibration apparatus does not vibrate during periods of image formation.

21. The method of claim 19, further comprising the step of:

varying the vibration intensity of said vibration apparatus for each of plural colors of toner independently of one another.

22. The method of claim 19, further comprising the step of:

controlling, with a toner supply controlling device, the amount of toner supplied to the developing tub.

23. A method for supplying toner in an image forming apparatus, comprising the steps of:

storing unused toner in a toner hopper;

fixing the toner hopper on a toner hopper mounting part such that the toner hopper communicates with a developing tub through the toner hopper mounting part; and vibrating the toner hopper mounting part with a vibration apparatus mounted to said toner hopper mounting part;

wherein the vibration apparatus includes a piezoelectric element and the step of vibrating comprises the step of: vibrating the toner hopper mounting part with the piezoelectric element; and wherein the vibrating step comprises the step of: vibrating the toner hopper mounting part in accordance with the following inequalities:

$$fm/\sqrt{2}<fh<\sqrt{2}\cdot fm$$

where fm is the frequency of vibration of the vibration apparatus, and fh is the inherent vibration frequency of the toner hopper.

24. The method of claim 23, further comprising the step of:

controlling the frequency of vibration of the vibration apparatus.

25. The method of claim 23, further comprising the step of:

determining whether a density of a standard density pattern on the latent image carrier is equal to or less than a predetermined density; and wherein the step of vibrating further comprises the step of:

resonating the toner hopper with the toner hopper mounting part when the density of the standard density pattern is equal to or less than the predetermined density.

26. The method of claim 23, further comprising:

controlling the vibration apparatus so that the vibration apparatus does not vibrate during periods of image formation.

27. The method of claim 23, further comprising the step of:

varying the vibration intensity of said vibration apparatus for each of plural colors of toner independently of one another.

28. The method of claim 23, further comprising the step of:

controlling, with a toner supply controlling device, the amount of toner supplied to the developing tub.

29. A developing apparatus for supplying toner to a latent image carried on a latent image carrier and converting the latent image to a visible image with the toner, comprising:

hopper means for holding unused toner;

developing tub means for charging toner received from the hopper means; and mounting means provided between the developing tub means and the hopper means for connecting the hopper means to the developing tub means, said hopper means being adapted to be mounted to and removed from said mounting means, said mounting means including vibration means for vibrating the mounting means;

wherein the frequency of vibration applied by the vibration means, fm, and the inherent vibration frequency of the mounting means, fs, satisfy the following inequalities:

$$fm/\sqrt{2}<fs<\sqrt{2}\cdot fm.$$

30. A developing apparatus for supplying toner to a latent image carried on a latent image carrier and converting the latent image to a visible image with the toner, comprising:

hopper means for holding unused toner;

developing tub means for charging toner received from the hopper means; and mounting means provided between the developing tub means and the hopper means for connecting the hopper means to the developing tub means, said hopper means being adapted to be mounted to and removed from said mounting means, said mounting means including vibration means for vibrating the mounting means;

wherein the frequency of vibration applied by the vibration means, fm, and the inherent vibration frequency of the hopper means, fh, satisfy the following inequalities:

$$fm/\sqrt{2}<fh<\sqrt{2}\cdot fm.$$

31. The apparatus of claim 30, further comprising:

control means for controlling the frequency of vibration applied by the vibration means.

32. An image forming apparatus, comprising:

image carrying means for carrying a latent image;

first developing means configured to supply toner to the latent image carried on the image carrying means and convert the latent image to a visible image with the toner, said first developing means including hopper means for holding unused toner, developing tub means for charging toner received from the hopper means, and mounting means provided between the developing tub means and the hopper means for connecting the hopper means to the developing tub means, said hopper means being adapted to be mounted to and removed from said mounting means, said mounting means including vibration means for vibrating the mounting means; and control means for causing the vibration means to vibrate such that the hopper means resonates when a standard density pattern on the image carrying means is equal to or less than a predetermined value so that the unused toner in said hopper means flows from said hopper means through said mounting means to supply said image carrying means with toner;

wherein said vibration means comprises: a plurality of vibration apparatuses corresponding to a plurality of developing apparatuses; and wherein said control means comprises: means for changing the vibration intensity of the vibration apparatuses independently of one another.

33. The apparatus of claim 32, wherein said hopper means comprises:

a toner supply control means for regulating the amount of toner that flows from the hopper means to the developing tub means.

34. The apparatus of claim 33, wherein said toner supply control means comprises:

a mesh having a mesh size of 50 to 500 micrometers.

* * * * *